US007690749B2

(12) United States Patent
Kachi

(10) Patent No.: US 7,690,749 B2
(45) **Date of Patent: *Apr. 6, 2010**

(54) METHOD FOR EVALUATING BLEEDING, AND IMAGE RECORDING METHOD AND APPARATUS

(75) Inventor: Yasuhiko Kachi, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 1072 days.

This patent is subject to a terminal disclaimer.

(21) Appl. No.: 11/092,660

(22) Filed: Mar. 30, 2005

(65) Prior Publication Data

US 2005/0219283 A1 Oct. 6, 2005

(30) Foreign Application Priority Data

Mar. 31, 2004 (JP) ..... 2004-107856

(51) Int. Cl.
*B41J 2/01* (2006.01)

(52) U.S. Cl. ..... 347/19; 347/14; 347/43

(58) Field of Classification Search ..... 347/14–15, 347/40–41, 102, 43, 5, 9, 19
See application file for complete search history.

(56) References Cited

U.S. PATENT DOCUMENTS 4,554,181 A * 11/1985 Cousin et al. ..... 428/32.3
5,140,339 A * 8/1992 Higuma et al. ..... 347/43
5,608,438 A * 3/1997 Koike et al. ..... 347/100
6,347,856 B1 * 2/2002 Arquilevich et al. ..... 347/19
6,474,768 B1 * 11/2002 Yano et al. ..... 347/19

FOREIGN PATENT DOCUMENTS

JP 3-247450 A 11/1991
JP 4-173250 A 6/1992
JP 2000-71481 A 3/2000

* cited by examiner

*Primary Examiner*—Lam S Nguyen
(74) *Attorney, Agent, or Firm*—Birch, Stewart, Kolasch & Birch LLP

(57) ABSTRACT

The method for evaluating bleeding into a recording medium of ink discharged onto the recording medium, the method comprises the steps of: outputting a bleeding evaluation print including a plurality of bleeding evaluation patches created by recording lines of a prescribed length of ink colors, at a prescribed width, and varying at least one of a recording speed at which recording data is recorded onto the recording medium, a volume of ink discharged, and a fixing energy which fixes the discharged ink onto the recording medium, as a parameter, between a plurality of different levels; measuring density of each of the bleeding evaluation patches in the outputted bleeding evaluation print; and evaluating the bleeding of the ink into the recording medium according to a density measurement result on the bleeding evaluation patches.

9 Claims, 14 Drawing Sheets

| DETERMINATION RESULT | TARGET VALUE | FIRST WEIGHTING FACTOR | SECOND WEIGHTING FACTOR |
|---|---|---|---|
| $D_{max}$ | $D_0$ | $a_1$ (≒1) | $f_1$ |
| LINE WIDTH E(A) | $A_B$ | $a_2$ (≒20) | $f_2$ |
| RAGGEDNESS $\sigma_{B-E(B)}$ | | $a_2$ (≒50) | $f_3$ |

FIG.13

| IMAGE QUALITY MODE | $f_1$ DENSITY | $f_2$ LINE WIDTH | $f_3$ RAGGEDNESS | REMARKS |
|---|---|---|---|---|
| TEXT | 1 | 3 | 3 | EMPHASIZE LINE WIDTH AND RAGGEDNESS |
| TEXT + IMAGE | 2 | 3 | 3 | EMPHASIZE LINE WIDTH, RAGGEDNESS, AND CERTAIN DENSITY |
| IMAGE | 3 | 3 | 3 | EMPHASIZE ALL |

FIG.14

| IMAGE QUALITY MODE | CONVEYANCE VELOCITY | FIXING ENERGY | PARTICLE DIAMETER |
|---|---|---|---|
| TEXT | $V_{max}$ | VARIABLE | $\phi_{Hi}$ |
| TEXT +IMAGE | $V_{max} \sim V_{min}$ | VARIABLE | VARIABLE |
| IMAGE | VARIABLE | VARIABLE | VARIABLE |

METHOD FOR EVALUATING BLEEDING, AND IMAGE RECORDING METHOD AND APPARATUS

BACKGROUND OF THE INVENTION

1. Field of the Invention

The present invention relates to a method for evaluating bleeding and an image recording method and apparatus, and more particularly, to technology for achieving high-quality image recording by evaluating bleeding of ink and preventing bleeding, in an image recording apparatus which records images by discharging ink onto a recording medium from a plurality of nozzles.

2. Description of the Related Art

Conventionally, as an example of an image recording apparatus, an inkjet recording apparatus that has an inkjet head (ink discharge head) arranged with an array of multiple nozzles is known. The inkjet recording apparatus forms an image on a recording medium by discharging ink from the nozzles while the inkjet head and the recording medium are moved relatively.

Conventionally, various methods of discharging the ink for such an inkjet recording apparatus are known. For example, the inkjet recording apparatus is known as a method of a piezoelectric system in which an oscillating plate constituting part of a pressure chamber (ink chamber) is deformed by the deformation of a piezoelectric element (piezoelectric ceramics) to vary the capacity of the pressure chamber, ink is introduced into the pressure chamber through an ink supply channel during the capacity increase of the pressure chamber, and the ink in the pressure chamber is discharged as droplets from a nozzle when the capacity of the pressure chamber decreases. Moreover, the inkjet recording apparatus is also known as a method of a thermal inkjet system in which the ink is heated to create air bubbles and is discharged by the energy of expansion when the air bubbles increase in size.

In an image recording apparatus having an ink discharge head such as an inkjet recording apparatus, ink is supplied to the ink discharge head from an ink tank storing ink, via ink supply channels, and ink is discharged by one of the various methods described above. However, depending on the type of ink and the type of recording medium used, the ink dots (ink droplets) may bleed after landing on the recording medium, thereby disrupting the shape of the dots and blurring the image. In cases where a color image is recorded by using a plurality of inks of different colors, then if an ink of one color is recorded in an overlapping fashion onto ink of a different color recorded previously, before the previously recorded ink has dried, then bleeding and mixing between the colors occurs and image quality declines.

Therefore, conventionally, various methods have been proposed in order to improve image quality by preventing image blurring caused by ink bleeding, and color mixing and color bleeding caused when inks of different colors are recorded in an overlapping fashion.

In one known example, ink dots of respective colors ejected from respective color recording heads are recorded during one rotation of a rotating body supporting the recording medium, in a thinned-out fashion whereby the dots are separated by at least one dot space in the sub-scanning direction, which coincides with the direction of rotation of the recording medium (see, for example, Japanese Patent Application Publication No. 2000-71481). Therefore, mixing and spreading of adjacent ink dots is prevented, while achieving high-quality image recording.

In a further example, an inkjet recording apparatus comprises a device for estimating the state of drying of the recorded ink, and the recording intervals between one recording action and the next recording action are altered by changing the conveyance velocity of the recording medium and changing the interval between the recording heads, in accordance with the estimation results. In this way, it is possible to prevent recording irregularities in the regions where different inks are superimposed, while maintaining the through-put of the recording apparatus, and therefore, image quality is improved (see, for example, Japanese Patent Application Publication No. 03-247450).

Yet a further example describes a color inkjet recording method in which, in the same printing region, printing by at least one head of a plurality of heads is carried out after leaving a time period sufficiently longer than the printing delay time of the adjacent head, from the time of printing by another head. In this way, color prints which do not contain color bleeding can be obtained (see, for example, Japanese Patent Application Publication No. 04-173250).

However, in Japanese Patent Application Publication No. 2000-71481, for example, the dots are recorded in a thinned-out fashion during one rotation of the rotating body holding the recording medium, and therefore it is necessary to carry out a plurality of rotations in order to record one full image. Therefore, productivity is low.

Furthermore, Japanese Patent Application Publication No. 03-247450 comprises a device for estimating the state of drying and a device for adjusting the dot recording interval, in such a manner that the interval at which subsequent dots are recorded is adjusted in accordance with the state of drying. However, no device for drying or curing the ink that has been deposited on the recording medium is provided, and the ink is simply left to dry naturally. Therefore, it is not possible always to prevent color mixing, blurring or bleeding in the image, in a reliable fashion.

Moreover, Japanese Patent Application Publication No. 04-173250 simply sets a time period greater than the printing delay between adjacent dots, but it does not comprise a device for adjusting drying or curing, and therefore has the same problems as Japanese Patent Application Publication No. 03-247450.

SUMMARY OF THE INVENTION

The present invention has been contrived in view of the aforementioned circumstances, an object thereof being to provide a method for evaluating bleeding and an image recording method and apparatus whereby bleeding of ink on the surface of the recording medium can be evaluated, and high-quality images can be recorded at high speed, while preventing ink bleeding.

In order to attain the aforementioned object, the present invention is directed to a method for evaluating bleeding into a recording medium of ink discharged onto the recording medium, the method comprising the steps of: outputting a bleeding evaluation print including a plurality of bleeding evaluation patches created by recording lines of a prescribed length of ink colors, at a prescribed width, and varying at least one of a recording speed at which recording data is recorded onto the recording medium, a volume of ink discharged, and a fixing energy which fixes the discharged ink onto the recording medium, as a parameter, between a plurality of different levels; measuring density of each of the bleeding evaluation patches in the outputted bleeding evaluation print; and evaluating the bleeding of the ink into the recording medium according to a density measurement result on the bleeding evaluation patches.

Accordingly, since bleeding is evaluated by measuring the density of a print outputted in order to evaluate bleeding of ink, then it is possible to evaluate bleeding readily and automatically.

Preferably, the method further comprises the steps of: measuring density of lines of the ink colors constituting the bleeding evaluation patches in a substantially perpendicular direction to the lines; calculating values relating to a maximum density, a raggedness which indicates extent of wavering of edges of the lines, and a width of the lines, according to a density measurement result on the lines; and evaluating the bleeding according to the values.

Preferably, the method further comprises the step of: evaluating the bleeding by means of an evaluation value providing a numerical evaluation of bleeding by using previously established prescribed weighting factors corresponding to values of a difference between a previously established target density value of the lines and the calculated value of the density, a difference between a previously established target width value of the lines and the calculated width of the lines, and the raggedness.

According to the present invention, the bleeding of ink can be evaluated numerically and therefore an evaluation of bleeding can be made readily. The weighting factors used here may be first weighting factors $a_1$, $a_2$, $a_3$, which are intrinsic to the apparatus as described hereafter, and second weighting factors $f_1$, $f_2$, $f_3$, relating to the printing quality.

Preferably, the prescribed weighting factors are set in accordance with an image quality mode which indicates whether an item to be recorded is text, or image, or both text and image. By changing the factors of the bleeding evaluation in accordance with the image quality mode in this way, it is possible to evaluate bleeding in accordance with the objective of image recording.

In order to attain the aforementioned object, the present invention is also directed to an image recording method for recording an image by discharging ink onto a recording medium according to recording data, the method comprising the step of performing image recording by setting control parameters for controlling at least one of the recording speed at which the recording data is recorded onto the recording medium, the discharge volume of ink to be discharged, and the fixing energy which fixes the discharged ink onto the recording medium, according to bleeding evaluation results obtained by the above-described bleeding evaluation method. Thereby, high-quality image recording which avoids bleeding becomes possible.

Preferably, the method further comprises the step of setting control parameters in accordance with an image quality mode which indicates whether an item to be recorded is text, or image, or both text and image. Thereby, it is possible to achieve image recording corresponding to the recording objectives.

In order to attain the aforementioned object, the present invention is also directed to a bleeding evaluation apparatus for evaluating bleeding into a recording medium of ink discharged onto the recording medium, the apparatus comprising: a bleeding evaluation print output device which outputs a bleeding evaluation print including a plurality of bleeding evaluation patches created by recording lines of a prescribed length of ink colors, at a prescribed width, and varying at least one of a recording speed at which recording data is recorded onto the recording medium, a volume of ink discharged, and a fixing energy which fixes the discharged ink onto the recording medium, as a parameter, between a plurality of different levels; a density measurement device which measures density of each of the bleeding evaluation patches in the outputted bleeding evaluation print; and a bleeding evaluation device which evaluates the bleeding of the ink into the recording medium according to a density measurement result on the bleeding evaluation patches.

Preferably, the density measurement device measures density of lines of the ink colors constituting the bleeding evaluation patches in a substantially perpendicular direction to the lines; and the bleeding evaluation device calculates values relating to a maximum density, a raggedness which indicates extent of wavering of edges of the lines, and a width of the lines, according to a density measurement result on the lines, and evaluates the bleeding by means of an evaluation value providing a numerical evaluation of bleeding by using previously established prescribed weighting factors corresponding to values of a difference between a previously established target density value of the lines and the calculated value of the density, a difference between a previously established target width value of the lines and the calculated width of the lines, and the raggedness.

Preferably, the apparatus further comprises: an image quality mode determination device which determines an image quality mode indicating whether an item to be recorded is text, or image, or both text and image, according to the recording data, wherein the bleeding evaluation device sets the weighting factors in accordance with the determined image quality mode.

In this way, it is possible to prevent bleeding by evaluating bleeding through implementing the method for evaluating bleeding described above by means of concrete devices.

In order to attain the aforementioned object, the present invention is also directed to an image recording apparatus which records an image by discharging ink onto a recording medium according to recording data, the apparatus comprising: the above-described bleeding evaluation apparatus; a recording speed control device which controls the recording speed at which the recording data is recorded onto the recording medium; a discharge volume control device which controls the volume of the ink discharged; a fixing control device which controls the fixing energy which fixes the discharged ink onto the recording medium; a parameter setting device which sets control parameters for controlling the recording speed control device, the discharge volume control device and the fixing control device, according to bleeding evaluation results obtained by the bleeding evaluation apparatus; and a bleeding prevention control device which implements image recording by controlling at least one of the recording speed control device, the discharge volume control device and the fixing control device, by means of the set control parameters.

Preferably, the parameter setting device sets the control parameters in accordance with an image quality mode indicating whether an item to be recorded is text, or image, or both text and image, according to the recording data.

By means of an image recording apparatus comprising a bleeding evaluation apparatus of this kind, it is possible to achieve high-quality image recording in which bleeding is prevented.

As described above, according to the method for evaluating bleeding and the image recording method and apparatus relating to the present invention, it is possible readily to evaluate bleeding of ink in a recording medium, and by recording images while controlling the various control devices according to the evaluation result, it is possible to achieve high-quality image recording in which bleeding is prevented.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIGS. 4A and 4B show a case where the ink is a solvent-based ink, and FIGS. 4C and 4D show a case where the ink is matrix-type curable ink;

FIGS. 5A and 5B show a case where the ink is a solvent-based ink, and FIGS. 5C and 5D show a case where the ink is matrix-type curable ink;

FIG. 13 is an illustrative diagram showing the relationship between image quality modes and weighting factors;

FIG. 14 is an illustrative diagram showing controllable parameters in a case where control options are restricted;

DETAILED DESCRIPTION OF THE PREFERRED EMBODIMENTS

Figure 1:
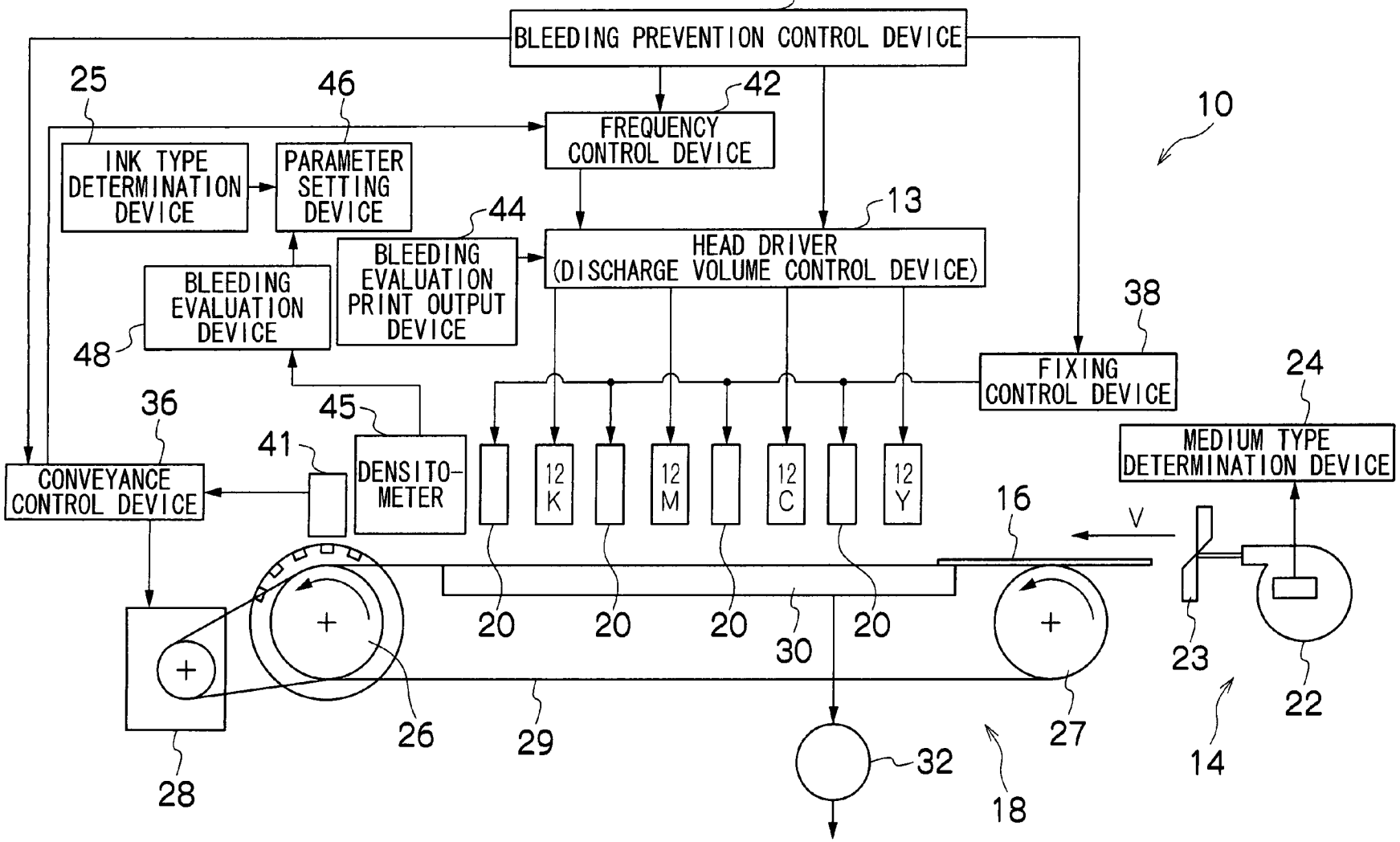
FIG. 1 is a general schematic drawing of an inkjet recording apparatus according to an embodiment of the present invention, showing at a block diagram in part.

FIG. 1 is a general schematic drawing of an inkjet recording apparatus according to first embodiment of the present invention, showing at a block diagram in part.

As shown in FIG. 1, the inkjet recording apparatus 10 comprises: a plurality of print heads 12Y, 12C, 12M, and 12K for ink colors of yellow (Y), cyan (C), magenta (M), and black (K), respectively; a head driver 13 for control to drive the print heads 12Y, 12C, 12M, and 12K; a conveyance unit 18 for supplying a recording paper 16 as a recording medium from a paper supply unit 14 to the print heads 12Y, 12C, 12M, and 12K; and a fixing medium 20 for fixing the ink deposited on the recording paper 16.

In FIG. 1, a magazine 22 for rolled paper (continuous paper) is shown as an example of the paper supply unit 14; however, a plurality of magazines with paper differences such as paper width and quality may be jointly provided. Moreover, paper may be supplied with a cassette that contains cut paper loaded in layers and that is used jointly or in lieu of a magazine 22 for rolled paper.

In the case of the configuration in which roll paper is used, a cutter 23 is provided as shown in FIG. 1, and the continuous paper is cut into a desired size by the cutter 23. When cut paper is used, the cutter 23 is not required.

In the embodiment of the present invention, an information recording medium such as a bar code and a wireless tag containing information about the type of paper is attached to a medium determination notch 22*a* in the magazine 22, and a medium determination device 24 for reading the information contained in the information recording medium is comprised in the inkjet recording apparatus 10. As described later, the information read by the medium determination device 24 is used to configure an optimum control parameter for recording the image to the type of paper so as to record the image. By the way, recording the image in present invention is included about recording by not only an image date, but also a text date and the like.

The recording paper 16 delivered from the magazine 22 retains curl due to having been loaded in the magazine 22. In order to remove the curl, heat is applied to the recording paper 16 in the decurling unit (not shown) by a heating drum in the direction opposite from the curl direction in the magazine 22. The heating temperature at this time is preferably controlled so that the recording paper 16 has a curl in which the surface on which the print is to be made is slightly round outward.

The conveyance unit 18 has a configuration in which an endless belt 29 is set around rollers 26 and 27 so that the portion of the endless belt 33 facing at least the nozzle face of the print heads 12Y, 12C, 12M, and 12K forms a horizontal plane (flat plane).

The belt 29 has a width that is greater than the width of the recording paper 16, and a plurality of suction apertures (not shown) are formed on the belt surface. A suction chamber 30 is disposed in a position facing the nozzle surface of the print heads 12Y, 12C, 12M, and 12K on the interior side of the belt 29, which is set around the rollers 26 and 27, as shown in FIG. 1; and the suction chamber 30 provides suction with a fan 27 to generate a negative pressure, and the recording paper 16 is held on the belt 29 by suction.

The belt 29 is driven in the counterclockwise direction in FIG. 1 by the motive force of a motor 28 being transmitted to at least one of the rollers 26 and 27 (for example, the left hand roller 26 in FIG. 1), which the belt 29 is set around, and the recording paper 16 held on the belt 29 is conveyed from right to left in FIG. 1 at the (relative) conveyance velocity V.

Figure 2:
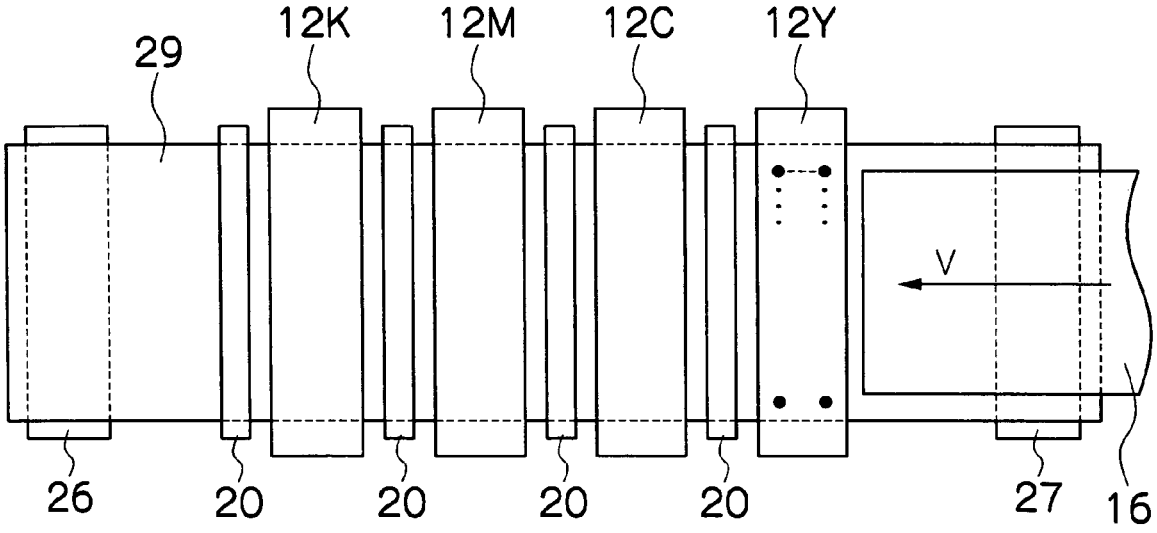
FIG. 2 is a plan view showing an enlarged view of the region of the print head shown in FIG. 1.

FIG. 2 is an enlarged plane view around the print heads 12Y, 12C, 12M, and 12K. As shown in FIG. 2, the print heads 12Y, 12C, 12M, and 12K include a plurality of nozzles corresponding to the YCMK ink colors, and forms a so-called full-line head in which each of the print heads 12Y, 12C, 12M, and 12K is disposed longitudinally in the paper width direction perpendicular to conveyance direction of the recording paper 16 among a length that corresponds to the maximum paper width.

In addition, the described full-line head includes a structure in which in which a plurality of short print heads are arranged between the entire width of the paper.

Furthermore, fixing devices 20 having a length corresponding to the full width of the recording paper 16 are provided respectively between the print heads 12Y, 12C, 12M, and 12K.

The print heads 12Y, 12C, 12M, and 12K corresponding to the respective ink colors are arranged in the order, Y (yellow), C (cyan), M (magenta), K (black), from the upstream side in the conveyance direction of the recording paper 16 (from right to left in the diagram). A color image can be formed on the recording paper 16 by discharging inks of respective colors from the print heads 12Y, 12C, 12M, and 12K, onto the recording paper 16 while conveying the recording paper 16 by means of the conveyance unit 18.

The print heads 12Y, 12C, 12M, and 12K are driven by the head driver 13, which controls the discharge volume, the discharge timing, and the like, of the discharged ink.

In this way, by means of the print heads 12Y, 12C, 12M, and 12K which constitute full line heads covering the full width of the paper provided for each ink color, it is possible to record an image onto the whole surface of the recording paper 16, at high speed, by means of one operation of moving the recording paper 16 and the print heads 12Y, 12C, 12M, and 12K relatively to each other (in other words, by means of one scan).

However, the present invention is not limited to a line type head, and may also be applied to a shuttle type head which moves back and forth reciprocally in the direction perpendicular to the paper conveyance direction.

Although a configuration with the four standard colors, YCMK, is described in the present embodiment, the combinations of the ink colors and the number of colors are not limited to these, and light and/or dark inks can be added as required. For example, a configuration is possible in which print heads for discharging light-colored inks such as light cyan and light magenta are added.

Furthermore, an ink type determination device 25 for determining the ink type is provided in the vicinity of an ink tank (not illustrated) which supplies inks of various colors to the respective print heads 12Y, 12C, 12M, and 12K. The ink type determination device 25 is not limited in particular, and in the case of a cartridge type ink tank, for example, it may be composed so as to read in an ID indicating the ink type from an information recording body, or the like, attached to the cartridge.

The fixing devices 20 serve to apply fixing energy to the ink discharged onto the recording paper 16 from the print heads 12Y, 12C, 12M, and 12K, to fix the ink on the recording paper 16, and suitable devices are used in accordance with the type of ink discharged.

Here, "fixing" means that an ink droplet no longer exists on the surface of the recording paper and the ink becomes fixed immovably on the paper, due to permeation of the ink deposited on the recording paper 16 into the fibers of the paper, and drying of the ink from the surface, or curing of the ink. In the case of water-based inks, for example, drying may be performed by causing the water forming the ink solvent to evaporate off by applying heat energy as drying energy. If a drying device is used as the fixing device 20, then possible examples include a heater, an infrared irradiation device or a fan (warm air fan) which blows a flow of (warm) air, and these devices may be used independently or in combination with each other.

Furthermore, in a method for curing and fixing the ink on the recording paper 16, a curable type of ink is used and the ink is cured by promoting a polymerization reaction in the ink. For example, if an ultraviolet (UV) curable ink or a general electromagnetic radiation-curable ink is used, then electromagnetic radiation or an electron beam is irradiated onto the ink, and heat energy may be also be applied, thereby curing the ink and causing it to become fixed onto the recording paper 16. In this case, the curable ink used may be a matrix-type curable ink, such as a UV curable ink or solid ink, and if a UV curable ink is used, then a UV light irradiating device, a halogen lamp or a laser light emitting diode is used as a curing device, whereas in the case of a solid ink, a cooling device, such as a Peltier element, a water cooling device, or a fan, is used.

Furthermore, in the case of an ink which changes phase with temperature, such as a wax-based ink, the ink is changed to a liquid state by applying heat energy inside the head, for example, and when the ink is discharged onto the recording medium, it can be solidified by cooling. Alternatively, if a sol gel type of ink is used, then it is also possible to control discharge and fixing by means of applying heat energy.

Fixing devices 20 are disposed respectively on the downstream sides of the four print heads 12Y, 12C, 12M, and 12K, as illustrated in FIG. 1, and these fixing devices 20 fix the ink discharged from the print heads, in such a manner that even when ink is subsequently discharged in the vicinity of the fixed ink, from the next print head, the respective ink colors do not mix due to bleeding of the ink.

The present embodiment achieves high-quality image recording by preventing bleeding of ink deposited on the recording paper 16, by varying and controlling at least one of: the relative conveyance velocity of the recording paper 16 with respect to the inkjet head (the print heads 12Y, and so on), the ink discharge volume, and the fixing energy for fixing the ink deposited on the recording paper 16.

In order to perform control for preventing bleeding in this way, the inkjet recording apparatus 10 according to the present embodiment comprises, in addition to the aforementioned elements: a head driver 13 forming a discharge volume control device which controls the ink discharge volume; a conveyance control device 36 which controls the relative conveyance velocity of the recording paper 16; a fixing control device 38 which controls the fixing energy of the fixing devices 20 that fix the ink; and a bleeding prevention control device 40 which prevents ink bleeding by varying and controlling at least one of the three control devices, namely, the discharge volume control device (head driver 13), the conveyance control device 36 and the fixing control device 38.

Furthermore, an encoder 41 for determining the relative conveyance velocity is provided on the roller 26, in order that the relative conveyance velocity can be controlled. Moreover, if the relative conveyance velocity is to be controlled, then the inkjet recording apparatus 10 also comprises a frequency control device 42 which controls the discharge frequency of the print heads (12Y and so on), in such a manner that a prescribed dot pitch is obtained in the recorded image.

Furthermore, as described in detail below, the inkjet recording apparatus 10 according to the present embodiment comprises a bleeding evaluation print output device 44 for outputting a bleeding evaluation print used for determining and evaluating ink bleeding in order to perform high-quality image recording while preventing ink bleeding; a densitometer 45 for measuring density in an outputted bleeding evaluation print; a bleeding evaluation device 48 for evaluating ink bleeding from the measurement results; and a parameter setting device 46 for setting optimal values for the respective control quantities, as control parameters, according to the bleeding evaluation results.

The head driver 13 forming the discharge volume control device controls the discharge volume of the ink discharged from the print heads 12Y, 12C, 12M, and 12K onto the recording paper 16, and although not illustrated in the drawings, it controls the ink discharge volume by controlling the internal pressure of the ink inside the ink chamber, or the drive values of the actuator (piezoelectric element) which deforms the ink chamber. By controlling the ink discharge volume, it is possible to control the size of the discharge ink droplets, in other words, the diameter of the ink particle deposited onto the surface of the recording paper 16.

The conveyance control device 36 controls the rotational speed of the motor 28 according to a determination signal from the rotary encoder 41. In this case, if an optimal value is set for the relative conveyance velocity parameter, then the rotation of the motor 28 is controlled in such a manner that the relative conveyance velocity of the recording paper 16 assumes the set velocity.

The fixing control device 38 causes the ink to become fixed by applying fixing energy, such as heat energy, to the ink deposited onto the recording paper 16, while controlling the level of this energy in accordance with the type of ink and the type of medium (the type of recording paper 16). Thereby, bleeding is prevented.

The bleeding prevention control device 40 prevents bleeding of the ink by controlling at least one of the head driver 13 forming the discharge volume control device, the conveyance control device 36, and the fixing control device 38. In specific terms, the control method involves controlling the respective control devices in accordance with the parameters established as respective optimal control quantities by the parameter setting device 46, as described below.

Furthermore, the frequency control device 42 controls the ink discharge timing from the respective print heads 12Y, 12C, 12M, and 12K in accordance with any change in the relative conveyance velocity of the recording paper 16, in such a manner that the recorded image is formed to the prescribed dot pitch.

Figure 3:
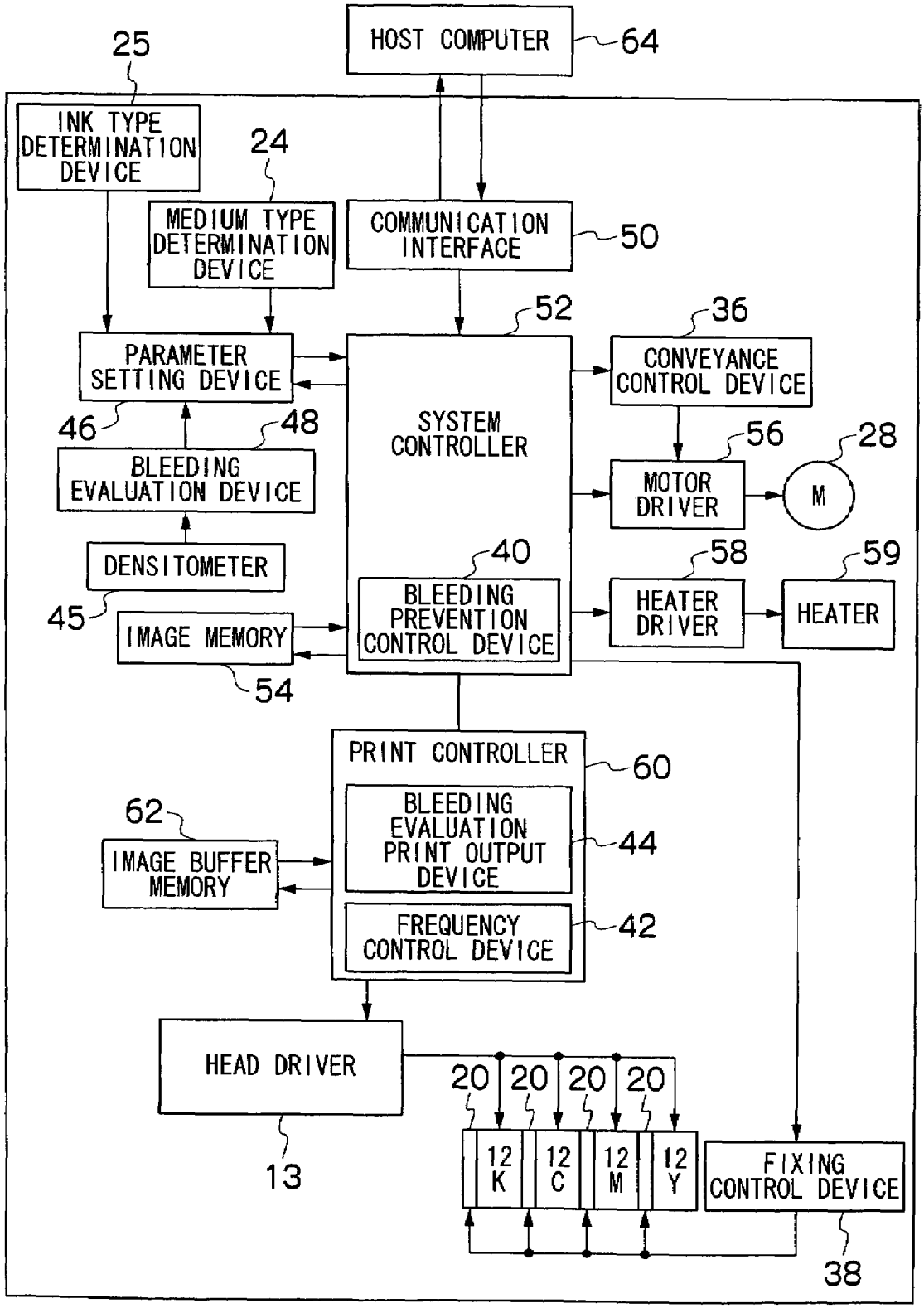
FIG. 3 is a block diagram showing the system composition of an inkjet recording apparatus according to the present embodiment.

FIG. 3 is a block diagram of the principal components showing the system configuration of the inkjet recording apparatus 10. The inkjet recording apparatus 10 has a communication interface 50, a system controller 52, an image memory 54, a motor driver 56, a heater driver 58, a print controller 60, an image buffer memory 62, a head driver 13, and other components.

The communication interface 50 is an interface unit for receiving image data sent from a host computer 64. A serial interface such as USB, IEEE1394, Ethernet, wireless network, or a parallel interface such as a Centronics interface may be used as the communication interface 50. A buffer memory (not shown) may be mounted in this portion in order to increase the communication speed. The image data sent from the host computer 64 is received by the inkjet recording apparatus 10 through the communication interface 50, and is temporarily stored in the image memory 54. The image memory 54 is a storage device for temporarily storing images inputted through the communication interface 50. The image memory 54 is not limited to memory composed of a semiconductor element, and a hard disk drive or another magnetic medium may be used.

The system controller 52 controls the communication interface 50, image memory 54, motor driver 56, heater driver 58, and other components. The system controller 52 has a central processing unit (CPU), peripheral circuits therefore, and the like. The system controller 52 controls communication between itself and the host computer 64, controls reading and writing from and to the image memory 54, and performs other functions, and also generates control signals for controlling a heater 59 and the motor 28 in the conveyance system.

The motor driver (drive circuit) 56 drives the motor 34 in accordance with commands from the system controller 52. The heater driver (drive circuit) 58 drives the heater 59 of the post-drying unit (not shown) or the like in accordance with commands from the system controller 52.

The print control unit 60 is a control unit having a signal processing function for performing various treatment processes, corrections, and the like, in accordance with the control implemented by the system controller 52, in order to generate a signal for controlling printing, from the image data in the image memory 54, and it supplies the print control signal (image data) thus generated to the head driver 13 (discharge amount control medium). Prescribed signal processing is carried out in the print control unit 60, and the discharge amount and the discharge timing of the ink droplets from the respective print heads 12Y, 12C, 12M, and 12K is controlled via the head driver 13, according to the image data. By this means, prescribed dot size and dot positions can be achieved.

The print control unit 60 is provided with the image buffer memory 62; and image data, parameters, and other data are temporarily stored in the image buffer memory 62 when image data is processed in the print control unit 60. The aspect shown in FIG. 3 is one in which the image buffer memory 62 accompanies the print control unit 60; however, the image memory 54 may also serve as the image buffer memory 62. Also possible is an aspect in which the print control unit 60 and the system controller 52 are integrated to form a single processor.

The head driver 13 drives actuators for the print heads 12Y, 12C, 12M and 12K of the respective colors according to the print data received from the print control unit 60. A feedback control system for keeping the drive conditions for the print heads constant may be included in the head driver 13.

Furthermore, in addition to the aforementioned elements, the inkjet recording apparatus 10 according to the present embodiment comprises, as control devices for preventing bleeding: the conveyance control device 36 which controls the relative conveyance velocity V of the recording paper 16; a fixing control device 38 which controls the fixing energy of the fixing devices 20; a frequency control device 42 which controls the ink discharge frequency in accordance with any change in the relative conveyance velocity V; a parameter setting device 46 which sets control parameters for controlling the respective control devices; the bleeding evaluation print output device 44 for outputting a bleeding evaluation print; the densitometer 45 which measures density in an outputted bleeding evaluation print; a bleeding evaluation print 48 which evaluates bleeding by reading in the density measurement results; and the like.

Furthermore, the medium type determined by the medium type determination device 24 and the ink type determined by the ink type determination device 25, and the like, are inputted to the parameter setting device 46. As described in detail below, the parameter setting device 46 sets control parameters for controlling the respective control devices in order to avoid ink bleeding, and it stores these parameters in association with the respective medium type and ink type. Furthermore, the bleeding evaluation print output device 44 creates data for bleeding evaluation patches which constitute a bleeding evaluation print, and sends this data to the print heads 12Y, 12C, 12M, and 12K via the head driver 13, thereby outputting a bleeding evaluation print. The bleeding evaluation print output device 44 may call up the bleeding evaluation patch data from a memory, rather than generating the data each time it is needed.

Here, the frequency control device 42 and the bleeding evaluation print output device 44 are provided inside the print control unit 60 and are controlled by the system controller 52.

Moreover, the system controller 52 is provided with a bleeding prevention control device 40 which prevents bleeding by controlling the respective control devices by means of the control parameters established by the parameter setting device 46.

Next, the principles of the method for preventing ink bleeding will be described with reference to the drawings. FIGS. 4A to 4D show a case where the recording medium (recording paper 16) is a permeable type of medium and FIGS. 5A to 5D shows a case where the recording medium is a non-permeable type of medium. A permeable type of recording medium is a medium in which the ink becomes fixed by permeating into an image receiving layer inside the recording medium, and examples of such a medium include ordinary paper, copy paper, uncoated paper, or the like. A non-permeable type of recording medium is a medium such as art paper for printing, coated paper, or the like, in which the ink solvent is not liable to permeate into the recording medium, and the ink solidifies (hardens) and becomes fixed principally on the surface of the recording medium.

Figure 4A:
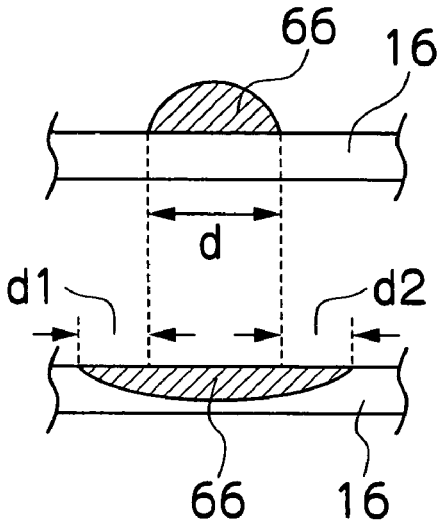
FIGS. 4A to 4D are illustrative diagrams showing the principles of a method for preventing ink bleeding in a permeable type of recording medium.
Figure 4B:
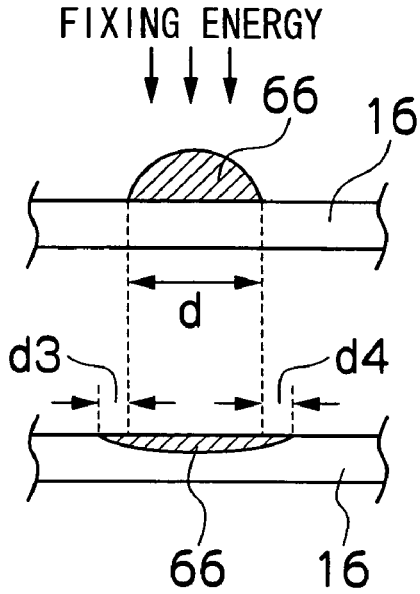
Figure 4C:
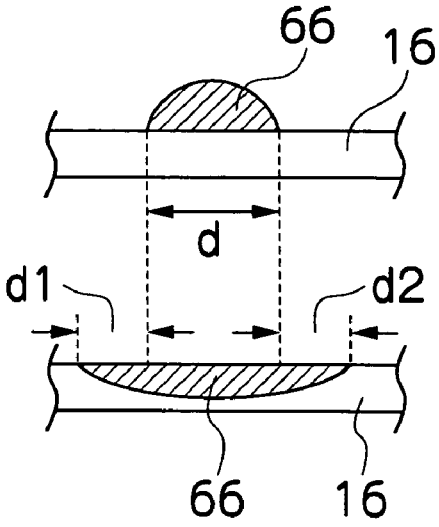
Figure 5A:
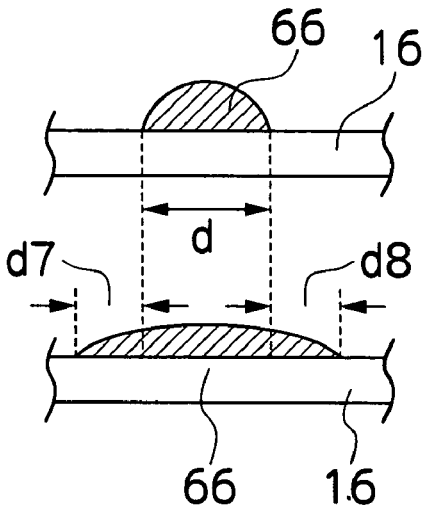
FIGS. 5A to 5D are illustrative diagrams showing the principles of a method for preventing ink bleeding in a non-permeable type of recording medium.
Figure 5B:
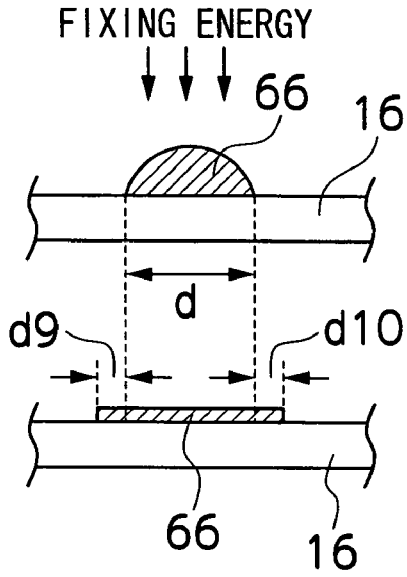
Figure 5C:
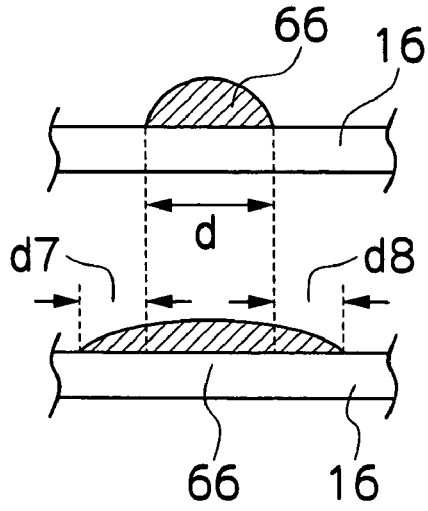

Here, in the case of a permeable type of recording medium (recording paper 16), as illustrated in FIG. 4A or FIG. 4C, "bleeding" refers to the portion (d1 and d2) of the ink which has permeated into the recording medium and spread so as to have a greater diameter than the dot diameter d of the ink droplet 66 discharged from the print head (12Y or the like) and deposited onto the recording medium. Furthermore, in the case of a non-permeable type of recording medium, as illustrated in FIG. 5A or FIG. 5C, "bleeding" refers to the portion (d7 or d8) of the ink which has spread on the recording medium to have a greater diameter than the dot diameter d of the ink droplet 66 discharged from the print head (12Y or the like) and deposited onto the recording medium.

In particular, in the case of a permeable type of recording medium, bleeding whereby the ink spreads in a radial fashion along the fibers of the recording medium as it permeates into the medium is known as "feathering".

Firstly, if the recording medium (recording paper 16) is a permeable type of medium, then as shown in FIG. 4A or FIG. 4C, the ink droplet 66 landing on the recording paper 16 permeates and spreads into the recording paper 16, and bleeding (d1, d2) caused by the osmotic pressure of the medium occurs.

If the ink 66 is a water-based ink, an oil-based ink, or an ink based on another type of solvent, drying energy (fixing energy), such as heat energy, is applied, thereby drying the solvent, in such a manner that bleeding (d3, d4) caused by permeation into the recording paper 16 is reduced, as shown in FIG. 4B.

Figure 4D:
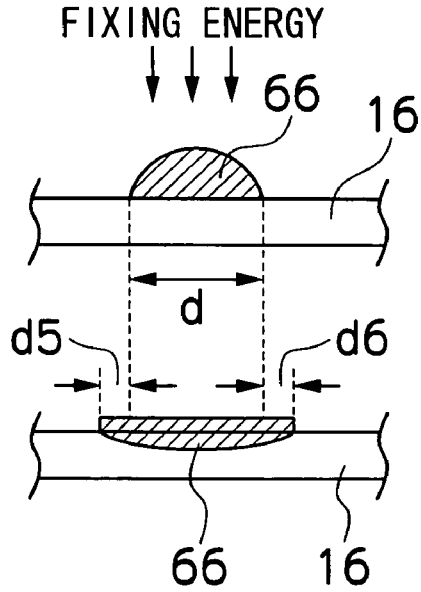

Furthermore, if the ink 54 is a UV curable ink, a solid ink, an electron beam curable ink, or other type of matrix-type curable ink, then the ink 54 is cured and increased in viscosity by applying a curing energy (fixing energy), in such a manner that bleeding is reduced (d5, d6), as shown in FIG. 4D.

Next, if the recording medium (recording paper 16) is a non-permeable type of medium, then as shown in FIG. 5A or FIG. 5C, the ink droplet 66 landing on the recording paper 16 spreads over the recording paper 16 due to surface energy, without permeating into the recording paper 16, and bleeding (d7, d8) occurs.

If the ink 66 is a water-based ink, an oil-based ink, or an ink based on another type of solvent, then drying energy (fixing energy), such as heat energy, is applied, thereby driving off the solvent, in such a manner that spreading of the ink 66 is prevented and the bleeding (d9, d10) is reduced.

Figure 5D:
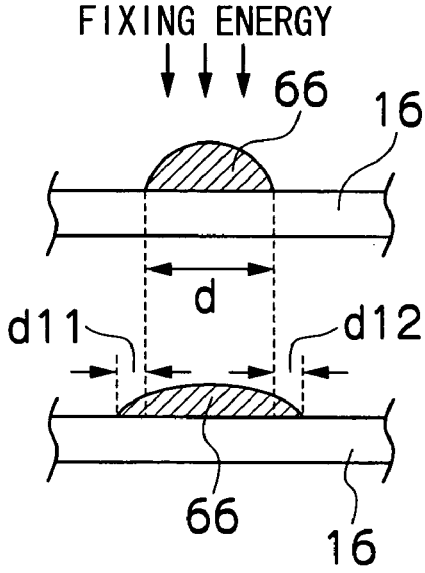

Furthermore, if the ink 66 is a UV curable ink, a solid ink, an electron beam curable ink, or other type of matrix-type curable ink, then the ink 66 is cured and increased in viscosity by applying a curing energy (fixing energy), in such a manner that spreading of the ink 66 is suppressed and bleeding is reduced (d11, d12), as shown in FIG. 5D.

Furthermore, in order to prevent bleeding of the ink, in addition to a method where spreading of the ink 66 deposited on the recording paper 16 is prevented by applying drying energy or curing energy in this way, it is also possible to reduce the size of the particles of ink that are discharged. By reducing the size of the particles of ink discharged, in the case of a solvent-based ink, the bleeding of ink into the recording paper 16 is reduced since the amount of solvent to be driven off is reduced. In the case of a matrix-type curable ink, reducing the size of the particles of ink reduces the thickness of the ink when it is deposited on the recording paper 16, and therefore accelerates the curing reaction. In this way, spreading of the shape of the ink dots is prevented and bleeding is reduced.

Next, a method for setting optimal parameters for preventing color bleeding will be described.

For this purpose, firstly, an ink bleeding evaluation pattern (bleeding evaluation print) is created. This bleeding evaluation print is used to evaluate the degree of bleeding of the ink under different conditions, and it is created by discharging ink onto the recording paper 16 from the print heads 12Y, 12C, 12M, and 12K, at various different levels of the ink discharge volume (ink particle size $\phi$), relative conveyance velocity V, and fixing energy E.

Figure 6:
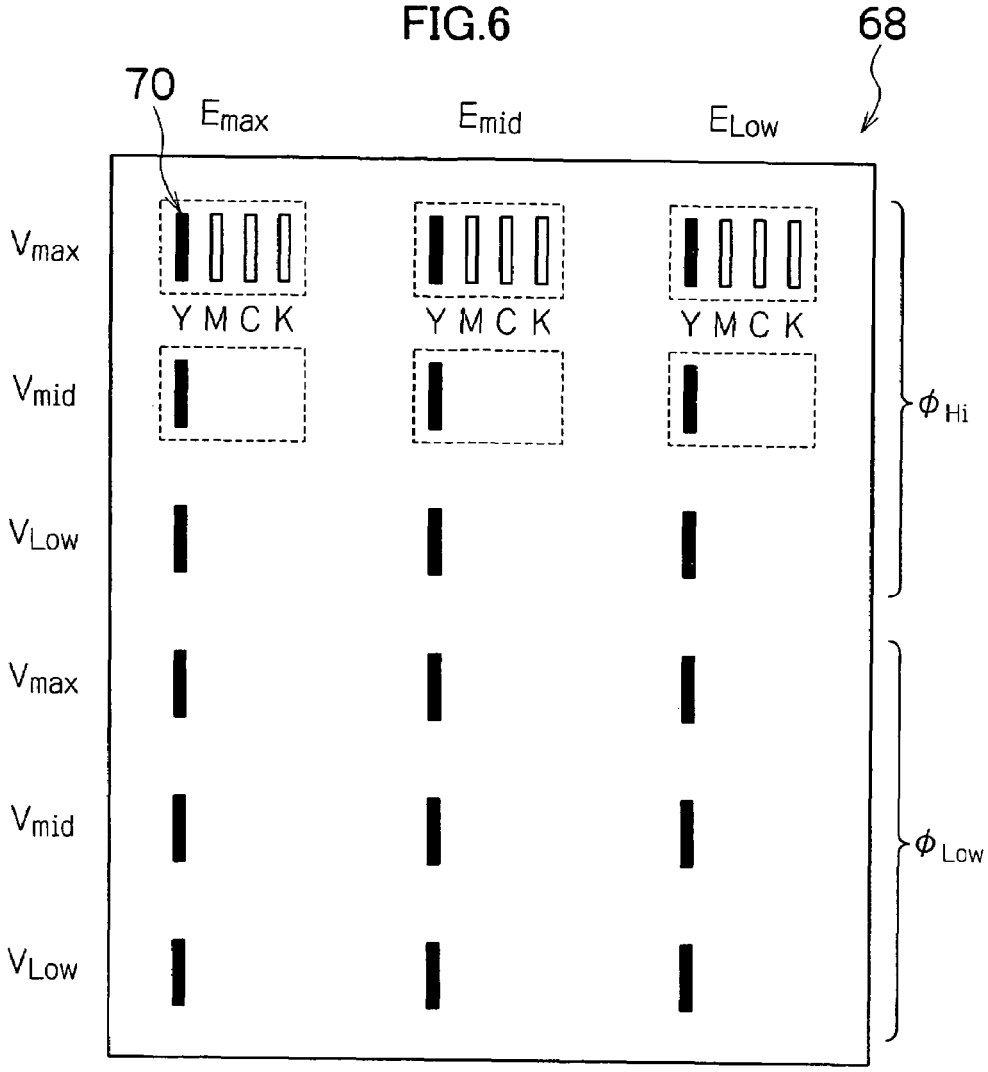
FIG. 6 is an illustrative diagram showing an example of a bleeding evaluation print according to a first embodiment.

FIG. 6 shows an example of an ink bleeding evaluation pattern (bleeding evaluation print). As shown in FIG. 6, the bleeding evaluation print 68 is formed by recording respective lines 70 of a prescribed length, of each color of ink, at two different levels of the ink particle size, large $\phi_{Hi}$ and small $\phi_{Low}$, and three levels, max, mid and low, of the relative conveyance velocity V and the fixing energy E. Furthermore, the bleeding evaluation print 68 is not limited to that illustrated, and it may incorporate other parameters and other factors relating to ink bleeding, such as the ambient printing temperature and humidity, or the like.

Figure 7A:
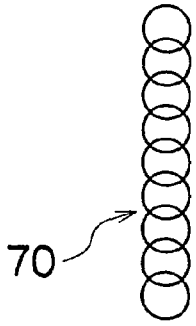
FIG. 7A is an illustrative diagram showing an enlarged view of an example of a bleeding evaluation patch of the bleeding evaluation print in FIG. 6.

The lines 70 may each be formed by one row of dots, as illustrated by the enlarged view in FIG. 7A, or one line 70 may be formed by a plurality of rows of dots. In the example shown in FIG. 7A, a bleeding evaluation print 68 is formed by recording 18 lines 70 of this kind for each color.

Figure 7B:
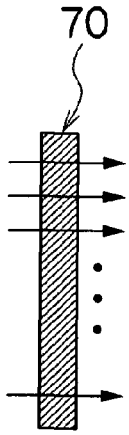
FIG. 7B is an illustrative diagram showing a method of measuring the density of this patch.

The density in the bleeding evaluation print 68 is measured by the densitometer 45, N times in a direction substantially perpendicular to the lines 70 (where N is at least 10), as illustrated in FIG. 7B. Furthermore, the scanning resolution is in steps of several μm to ten and several μm.

Figure 8A:
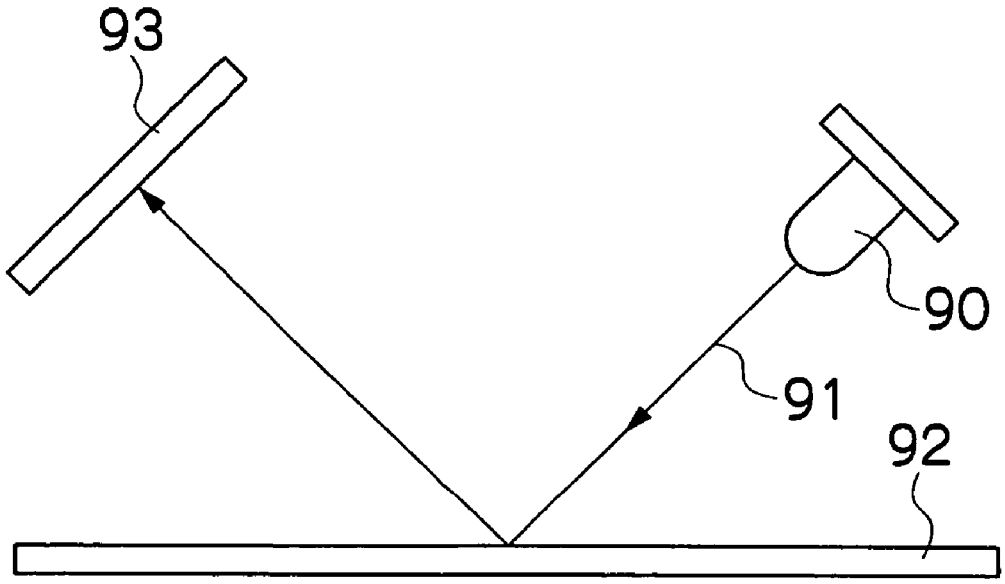
FIGS. 8A and 8B are illustrative diagrams indicating the principle of density measurement.
Figure 8B:
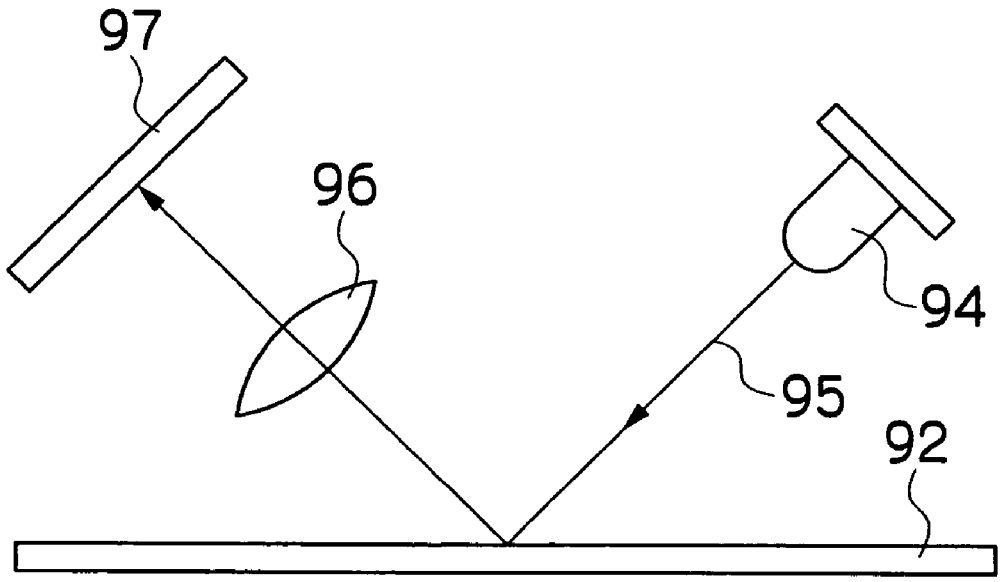

FIGS. 8A and 8B show the principle of density measurement. For example, according to the composition shown in FIG. 8A, a fine light spot 91 irradiated from an RGB light emitting element 90 is directed onto a measurement point on the medium 92, and the light reflected by the medium is received by a photoreceptor 93, such as a CCD element, whereby the density of the fine region can be measured. In this case, the RGB light emitting element may be composed, for example, by combining filters with an RGB light-emitting or halogen lamp. Alternatively, as shown in FIG. 8B, for example, a light beam 95 irradiated from an RGB light emitting element 94 may be directed onto a measurement point of the medium 92, the reflected light being condensed onto an area CCD 97 by means of a lens 96 in such a manner that the density can be measured.

Figure 9:
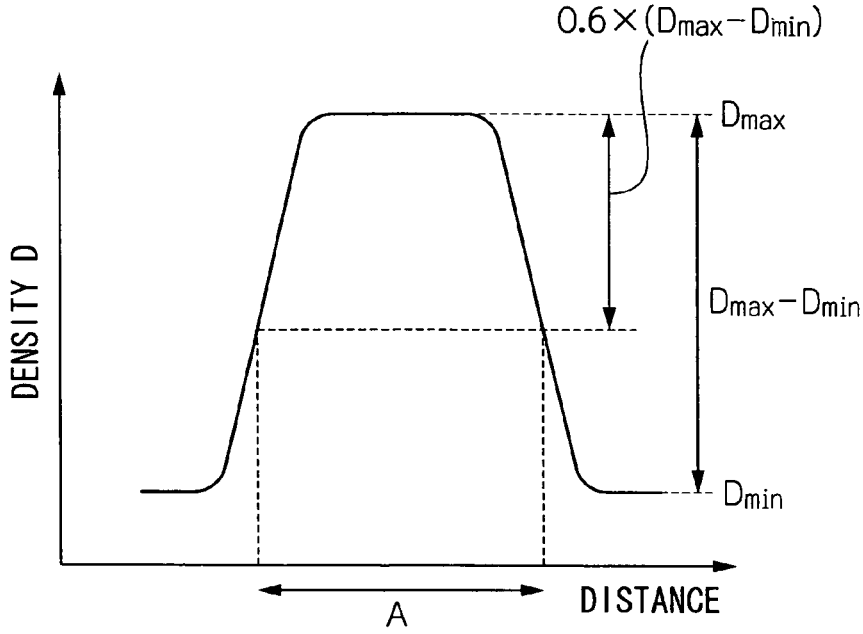
FIG. 9 is a line graph showing a measured density profile.

FIG. 9 shows a measurement result (for one measurement operation). In FIG. 9, the horizontal axis shows distance and the vertical axis shows density. This density measurement result is reported to the bleeding evaluation device 48 by the densitometer 45. The bleeding evaluation device 48 calculates the line width A of the measured lines 70 by finding the distance A between the points at which the density reaches a value which is 60% of the difference between the maximum density $D_{MAX}$ and minimum density $D_{MIN}$, in other words, $0.6\times(D_{MAX}-D_{MIN})$, below the maximum density value $D_{MAX}$, and it calculates the average value E(A) of the N measurements of the line width A.

Furthermore, the bleeding evaluation device 48 calculates a degree of raggedness for each line 70 from the density measurement results of the respective lines 70, in the following manner. The "raggedness" refers to the fact that the edges of lines or text that should be smooth and perfectly straight are wavering and the degree of raggedness provides a numerical evaluation of the amount of wavering in the lines.

Figure 10:
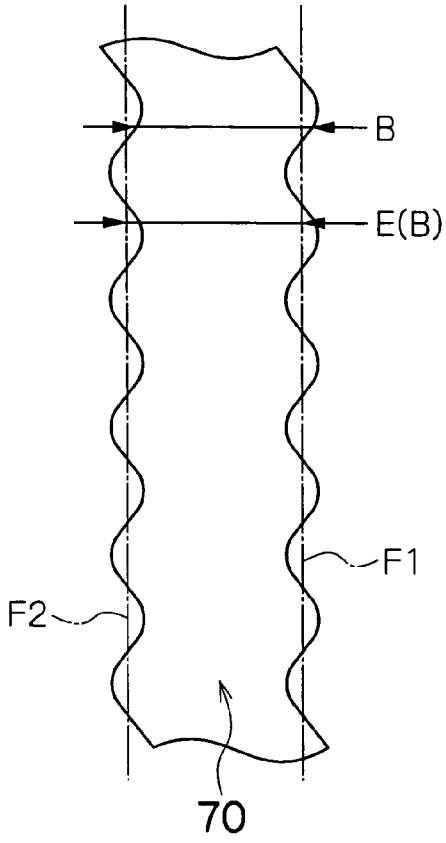
FIG. 10 is an illustrative diagram showing the measurement of raggedness.
Figures 11, 12:
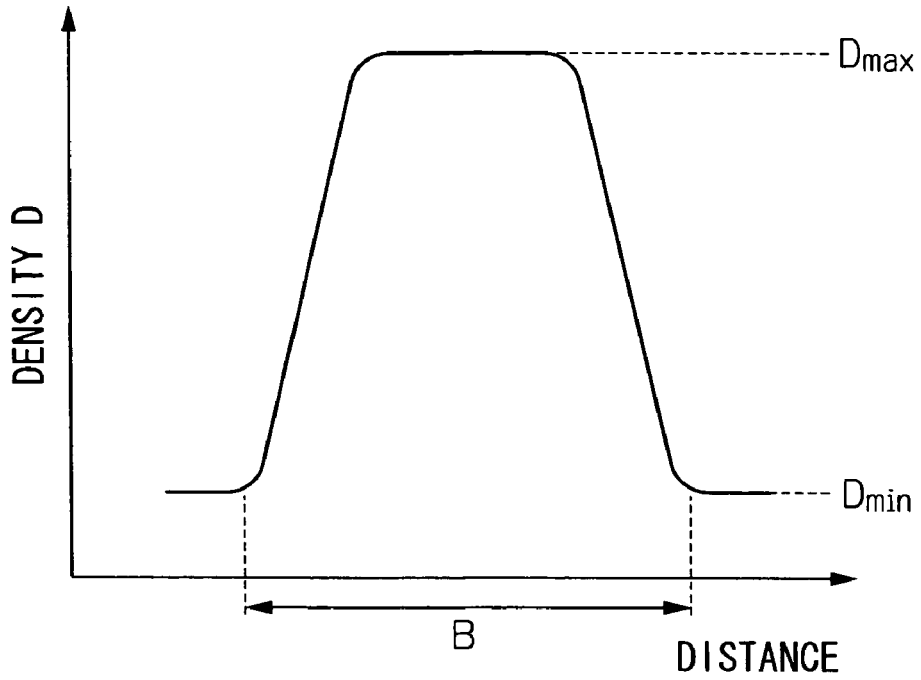
FIG. 11 is a line graph showing a density profile in raggedness measurement.
FIG. 12 is an illustrative diagram showing respective parameters for implementing control in order to prevent bleeding.

As shown in FIG. 7B, density measurement data such as that illustrated in FIG. 11 is obtained by measuring the widths of the respective lines 70. Thereby, the width B showing the actual edge positions is calculated, straight "fitting lines" F1 and F2 showing the average edge positions are determined as indicated by the single-dotted broken lines in FIG. 10, and the distance E(B) between these straight fitting lines F1 and F2 is calculated. The standard deviation $\sigma_{B-E(B)}$ of the differential B−E(B) between the width B indicating the actual edge positions as obtained by making N measurements in different measurement positions, and the average width E(B) indicating the positions of the straight fitting lines, indicates the degree of raggedness.

Two types of weighting factors as shown in FIG. 12 are established with respect to the maximum density $D_{MAX}$ obtained by measuring the lines 70, the average line width E(A) calculated from these measurement values, the degree of raggedness $\sigma_{B-E(B)}$, a previously established target density value $D_0$, and a target line width value $A_B$. In other words, first weighting factors $a_1$, $a_2$, $a_3$ that are intrinsic to the apparatus, and second weighting factors $f_1$, $f_2$, $f_3$ relating to printing quality, are established.

For example, in the case of a line 70 made of one row of dots such as that shown in FIG. 7A, the measurement results and the calculation values indicate that the first weighting factor $a_1$ is approximately 1, $a_2$ is approximately 20, and $a_3$ is approximately 50, when the maximum density $D_{MAX}$ is 1-2, the average line width E(A) is 30 μm to 60 μm, and the degree of raggedness $\sigma_{B-E(B)}$ is 9 μm to 18 μm. In this way, the first weighting factors adjust the balance between three physical quantities, namely, the maximum density $D_{MAX}$, the average line width E(A), and the degree of raggedness $\sigma_{B-E(B)}$, which are determined by the intrinsic properties of the apparatus.

Furthermore, as shown in FIG. 13, for example, the second weighting factors, $f_1$, $f_2$, $f_3$, are determined respectively in accordance with the image quality mode, namely, a text mode for recording text data only, an image mode for recording images only, and a combined mode for recording both text and images. For example, in the text mode, line width and raggedness are given more importance than density, in order that the edges are clearly defined so that the text is easy to read. Therefore, the weightings corresponding to line width and raggedness, $f_2$ and $f_3$, are set to larger values, namely $f_2=3$ and $f_3=3$, than the weighting corresponding to density $f_1=1$.

In this way, the second weighting factors adjust the balance between three physical quantities, namely, the maximum density $D_{MAX}$, the average line width E(A), and the degree of raggedness $\sigma_{B-E(B)}$, in accordance with the quality required in the recorded image.

Ink bleeding is evaluated according to these values, by means of the evaluation function given in the following equation (1):

$$\text{Bleeding evaluation function}=|D_0-D_{MAX}|\times a_1f_1+|A_B-E(A)|\times a_2f_2+\sigma_{B-E(B)}\times a_3f_3. \quad (1)$$

By means of this bleeding evaluation function, the bleeding evaluation device 48 evaluates bleeding of ink on the recording paper 16, according to the measurement results from the densitometer 45. Furthermore, according to bleeding evaluation results, the parameter setting device 46 establishes optimal parameters for suppressing bleeding, in relation to the control quantities, namely, the relative conveyance velocity, the ink discharge volume (ink particle size), and the fixing energy, for each type of recording paper 16 and each type of ink. These optimal parameters are stored in a prescribed memory.

In this case, as shown in FIG. 14, it is possible to restrict the setting options in such a manner that only certain restricted parameters can be controlled and varied in accordance with the image quality mode properties. For example, as shown in FIG. 14, in text mode, the conveyance velocity is set to maximum $V_{Max}$, the ink particle size is set to maximum $\phi_{Hi}$ and the fixing energy is variable, in such a manner that an optimal fixing energy can be selected.

Below, the action of the present embodiment is described with reference to the flowchart in FIG. 15.

Figure 15:
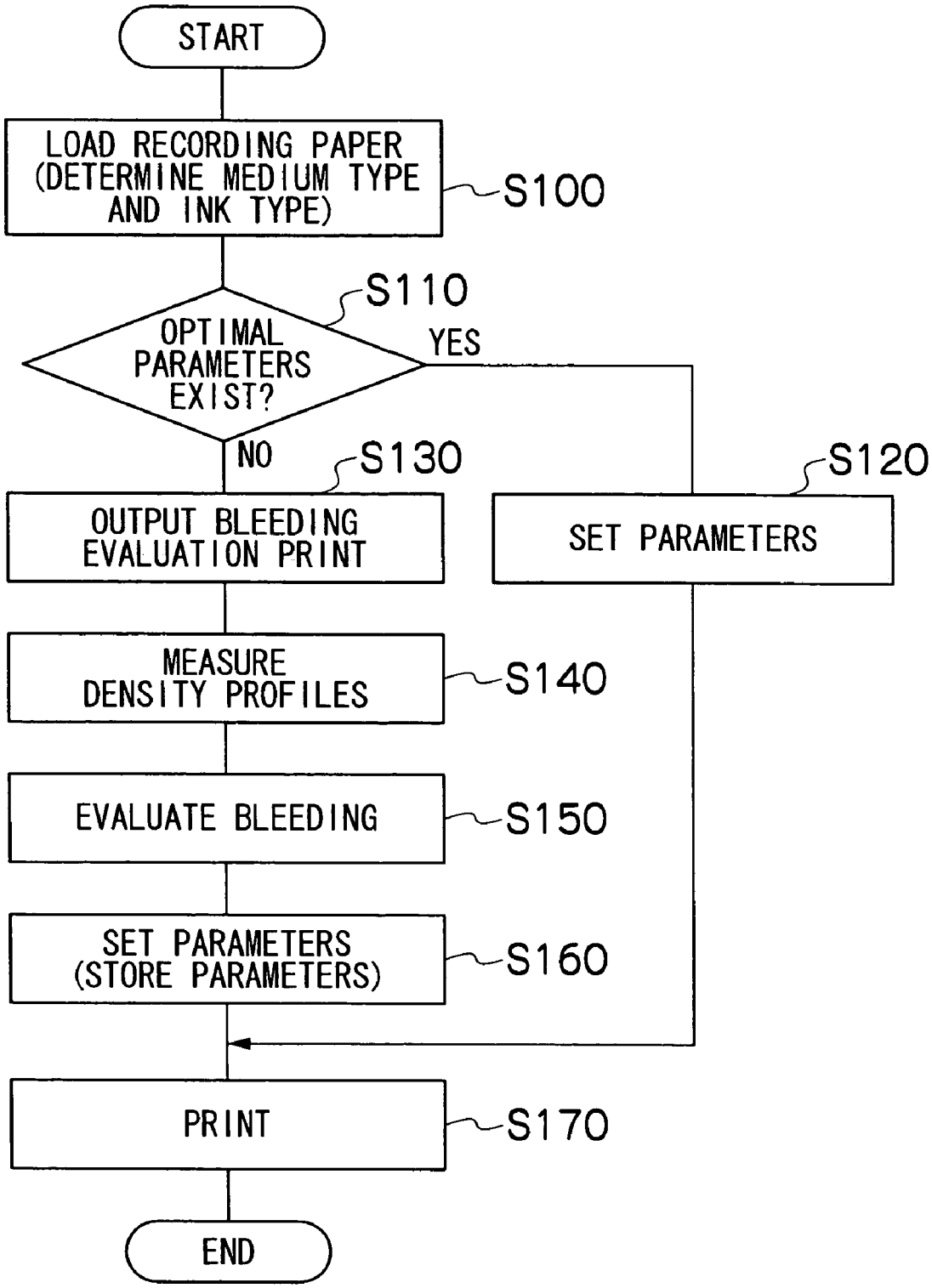
FIG. 15 is a flowchart illustrating the action of the first embodiment.

Firstly, at step S100 in FIG. 15, a magazine 22 for supplying recording paper 16 is loaded into the inkjet recording apparatus 10. As stated previously, an information recording body storing information such as the type of loaded recording paper 16 is attached to a medium type determination notch 22*a* on the magazine 22, and this information is read in by the medium type determination device 24. The information read in by the medium type determination device 24 is supplied to the parameter setting device 46. On the other hand, the ink type is determined by the ink type determination device 25 and the information on the ink type thus determined is also supplied to the parameter setting device 46.

At the next step, S110, the parameter setting device 46 judges whether or not optimal parameters corresponding to the supplied medium type information, or the like, have already been set and stored in a prescribed memory. If there exist optimal parameters corresponding to the medium type, or the like, then the procedure advances to step S120, and the bleeding prevention control device 40 calls up the optimal parameters for the relative conveyance velocity, fixing energy, and the like, stored in the prescribed memory, and sets them respectively in the head driver 13 (discharge volume control device), the conveyance control device 36, and the fixing control device 38.

On the other hand, if no optimal parameters exist corresponding to the determined medium type, or the like, then the procedure advances to step S130 in order to create an ink bleeding evaluation print for establishing optimal parameters. If an information recording body is not attached to the magazine 22, or if one is attached but it cannot be read by the medium type determination device 24, then a dummy medium type is sent to the parameter setting device 46, for example, and it is supposed that no corresponding optimal parameters exist. The procedure then advances to step S130.

At step S130, a bleeding evaluation print 68 such as that shown in FIG. 6 is created by means of the method described above. More specifically, ink of respective colors is discharged onto the recording paper 16 from the print heads 12Y, 12C, 12M, and 12K, at different values of the ink particle size $\phi$ (ink discharge volume), relative conveyance velocity V, and fixing energy E (curing energy, drying energy), and lines 70 of a prescribed length and prescribed width are recorded, thereby creating a bleeding evaluation print 68 such as that shown in FIG. 6.

Next, at step S140, the density of each line 70 of the bleeding evaluation print 68 is measured a plurality of times in a direction substantially perpendicular to the lines 70, as shown in FIG. 7B, by means of the densitometer 45, thereby yielding density profiles such as that shown in FIG. 11. This measurement is performed a prescribed number of times (at least ten times) with the scanning resolution set to an interval of between several μm and ten and several μm. The measured density profiles are supplied to the bleeding evaluation device 48.

Next, at step S150, the bleeding evaluation device 48 calculates the line width E(A), the raggedness $\sigma_{B-E(B)}$, and the like, from the density profiles of the lines 70 obtained using the densitometer 45, and it evaluates ink bleeding by substituting these values into the bleeding evaluation function expressed by the equation (1), in combination with the target density value $D_0$, the target line width value $A_B$, the first weighting factors $a_1$, $a_2$, $a_3$, and the second weighting factors $f_1$, $f_2$, $f_3$.

Next, at step S160, the parameter setting device 46 sets optimal parameters for preventing bleeding, such that the bleeding evaluation function which provides a numerical evaluation of bleeding assumes the lowest value. It stores the optimal parameters in the prescribed memory.

More specifically, the bleeding evaluation pattern producing the lowest value of the bleeding evaluation function is identified (the patch is identified in FIG. 6), and the corresponding discharge volume, conveyance velocity and fixing energy are set.

At step S170, using these optimal parameters, the bleeding prevention control device 40 controls at least one of the head driver 13 (discharge volume control device), the conveyance control device 36, the fixing control device 38, and the like, and image recording (printing) is performed. Furthermore, if it is judged that optimal parameters exist at step S110, and if these optimal parameters have been set at step S120, then printing is carried out at step S170.

When the relative conveyance velocity is controlled, the frequency control device 42 controls the ink discharge timing from the print heads 12Y, 12C, 12M, and 12K in accordance with the change in the relative conveyance velocity of the recording paper 16, in such a manner that a prescribed dot pitch is obtained in the recorded image. By this means, it is also possible to perform high-density recording by varying the recording speed in accordance with the ink fixing conditions.

In this way, according to the present embodiment, by previously setting optimal control parameters for preventing bleeding of ink in accordance with the type of recording medium and the type of ink, printing can be performed according to these control parameters, simply by determining the type of recording medium, and the like, loaded into the inkjet recording apparatus, and hence ink bleeding can be prevented readily, ink drying and curing can be controlled optimally for each type of medium, and printing can be performed under optimal conditions. Furthermore, by varying the fixing energy applied to the ink and the relative conveyance velocity of the medium, it is possible to create prints containing reduced bleeding, on various different types of medium.

Furthermore, even if the type of recording medium cannot be determined, or even if optimal control parameters have not been set for the recording medium in use, by creating a bleeding evaluation print and establishing optimal control parameters by measuring the density of the bleeding evaluation print in order to evaluate bleeding, it is possible to record high-quality images in which ink bleeding is prevented, at high speed. Furthermore, by outputting a bleeding evaluation print and evaluating bleeding in a bleeding evaluation device in this way, it is possible to set optimal parameters for preventing bleeding in respect of a new type of medium.

Next, a second embodiment according to the present invention is described below.

Figure 16:
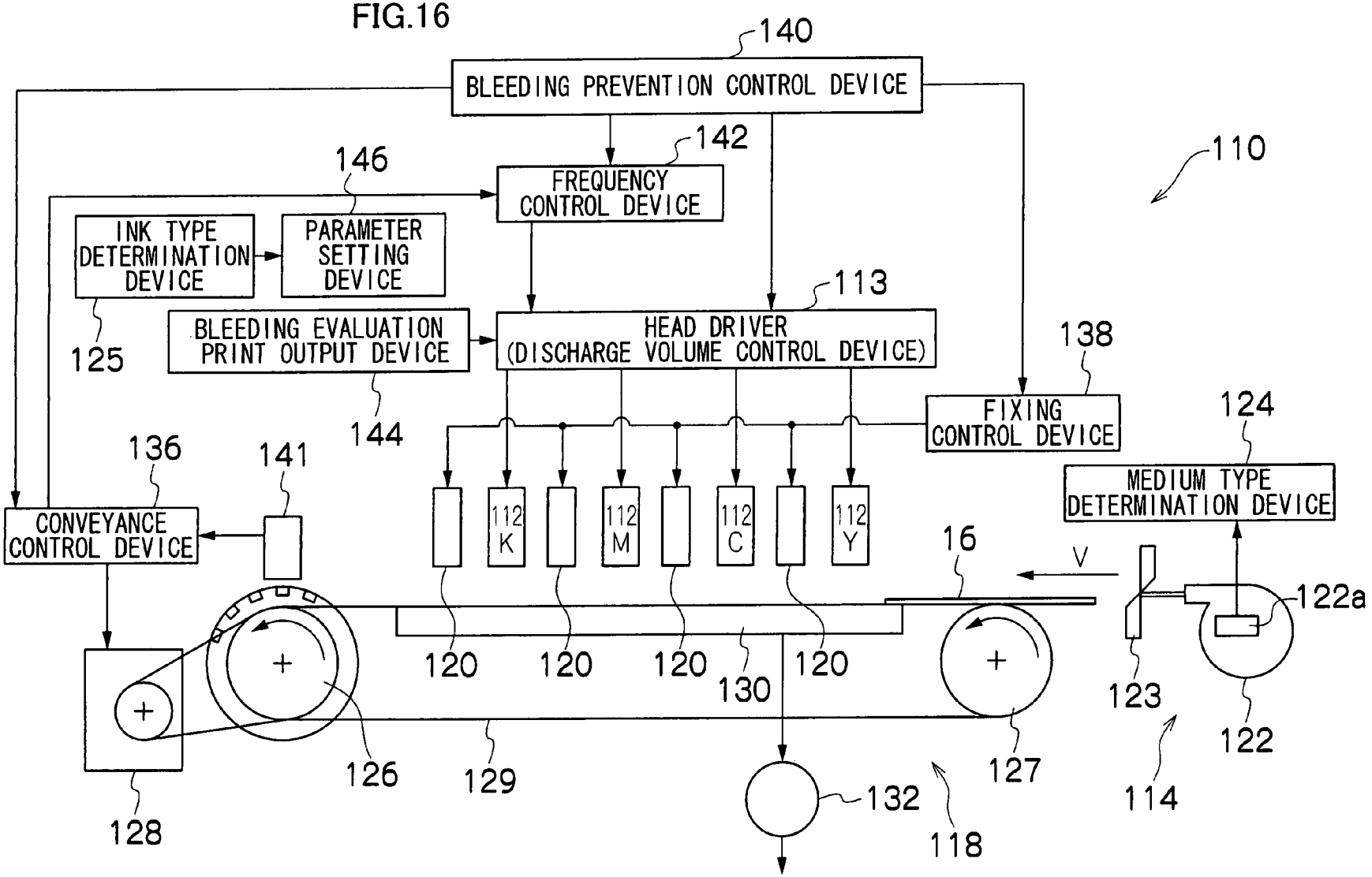
FIG. 16 is a general schematic drawing including a partial block diagram of the composition of an inkjet recording apparatus relating to a second embodiment of the image recording apparatus of the present invention.

FIG. 16 is a general schematic drawing of an inkjet recording apparatus according to second embodiment of the present invention, showing at a block diagram in part.

As shown in FIG. 16, the inkjet recording apparatus 110 comprises: a plurality of print heads 112Y, 112C, 112M, and 112K for ink colors of yellow (Y), cyan (C), magenta (M), and black (K), respectively; a head driver 113 for control to drive the print heads 112Y, 112C, 112M, and 112K; a conveyance unit 118 for supplying a recording paper 116 as a recording medium from a paper supply unit 114 to the print heads 112Y, 112C, 112M, and 112K; and a fixing medium 120 for fixing the ink deposited on the recording paper 116.

In FIG. 16, a magazine 122 for rolled paper (continuous paper) is shown as an example of the paper supply unit 114; however, a plurality of magazines with paper differences such as paper width and quality may be jointly provided. Moreover, paper may be supplied with a cassette that contains cut paper loaded in layers and that is used jointly or in lieu of a magazine 122 for rolled paper.

In the case of the configuration in which roll paper is used, a cutter 123 is provided as shown in FIG. 16, and the continuous paper is cut into a desired size by the cutter 123. When cut paper is used, the cutter 123 is not required.

In the embodiment of the present invention, an information recording medium such as a bar code and a wireless tag containing information about the type of paper is attached to a medium determination notch 122*a* in the magazine 122, and a medium determination device 124 for reading the information contained in the information recording medium is comprised in the inkjet recording apparatus 110. As described later, the information read by the medium determination device 124 is used to configure an optimum control parameter for recording the image to the type of paper so as to record the image. By the way, recording the image in present invention is included about recording by not only an image date, but also a text date and the like.

The recording paper 116 delivered from the magazine 122 retains curl due to having been loaded in the magazine 122. In order to remove the curl, heat is applied to the recording paper 116 in the decurling unit (not shown) by a heating drum in the direction opposite from the curl direction in the magazine 122. The heating temperature at this time is preferably controlled so that the recording paper 116 has a curl in which the surface on which the print is to be made is slightly round outward.

The conveyance unit 118 has a configuration in which an endless belt 129 is set around rollers 126 and 127 so that the portion of the endless belt 33 facing at least the nozzle face of the print heads 112Y, 112C, 112M, and 112K forms a horizontal plane (flat plane).

The belt 129 has a width that is greater than the width of the recording paper 116, and a plurality of suction apertures (not shown) are formed on the belt surface. A suction chamber 130 is disposed in a position facing the nozzle surface of the print heads 112Y, 112C, 112M, and 112K on the interior side of the belt 129, which is set around the rollers 126 and 127, as shown in FIG. 16; and the suction chamber 130 provides suction with a fan 132 to generate a negative pressure, and the recording paper 116 is held on the belt 129 by suction.

The belt 129 is driven in the counterclockwise direction in FIG. 16 by the motive force of a motor 128 being transmitted to at least one of the rollers 126 and 127 (for example, the left hand roller 126 in FIG. 1), which the belt 129 is set around, and the recording paper 16 held on the belt 129 is conveyed from right to left in FIG. 16 at the (relative) conveyance velocity V.

The print heads 112Y, 112C, 112M, and 112K include a plurality of nozzles corresponding to the YCMK ink colors, and forms a so-called full-line head in which each of the print heads 112Y, 112C, 112M, and 112K is disposed longitudinally in the paper width direction perpendicular to conveyance direction of the recording paper 116 among a length that corresponds to the maximum paper width.

A fixing medium 120 are disposed between each of the print heads 112Y, 112C, 112M, and 112K corresponding to the maximum paper width.

The print heads 112K, 112C, 112M, and 112Y are arranged in this order from the upstream side along the paper conveyance direction (direction from right to left in FIG. 16). A color print can be formed on the recording paper 16 by ejecting the inks from the print heads 112K, 112C, 112M, and 112Y, respectively, onto the recording paper 16 while conveying the recording paper 16.

Although the configuration with the YCMK four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added.

Furthermore, an ink type determination device 25 for determining the ink type is provided in the vicinity of an ink tank (not illustrated) which supplies inks of various colors to the respective print heads 12Y, 12C, 12M, and 12K. The ink type determination device 25 is not limited in particular, and in the case of a cartridge type ink tank, for example, it may be composed so as to read in an ID indicating the ink type from an information recording body, or the like, attached to the cartridge.

Similarly to the first embodiment, the fixing devices 20 serve to apply fixing energy to the ink discharged onto the recording paper 16 from the print heads 12Y, 12C, 12M, and 12K, to fix the ink on the recording paper 16, and suitable devices are used in accordance with the type of ink discharged.

Fixing devices 120 are disposed respectively on the downstream sides of the four print heads 112Y, 112C, 112M, and 112K, as illustrated in FIG. 16, and these fixing devices 120 fix the ink discharged from the print heads, in such a manner that even when ink is subsequently discharged in the vicinity of the fixed ink, from the next print head, the respective ink colors do not mix due to bleeding of the ink.

The present embodiment achieves high-quality image recording by preventing bleeding of ink deposited on the recording paper 116, by varying and controlling at least one of: the relative conveyance velocity of the recording paper 116 with respect to the inkjet head (the print heads 112Y, and so on), the ink discharge volume, and the fixing energy for fixing the ink deposited on the recording paper 116. Here, as stated previously, the ink discharge volume is controlled by the head driver 113 and the head driver 113 acts as a discharge volume control device.

In order to perform control for preventing bleeding in this way, the inkjet recording apparatus 110 according to the present embodiment comprises, in addition to the aforementioned elements: the head driver 113 forming a discharge volume control device which controls the ink discharge volume; a conveyance control device 136 which controls the relative conveyance velocity of the recording paper 116; a fixing control device 138 which controls the fixing energy of the fixing devices 120 that fix the ink; and a bleeding prevention control device 140 which prevents ink bleeding by varying and controlling at least one of the three control devices, namely, the discharge volume control device (head driver 113), the conveyance control device 136 and the fixing control device 138.

Furthermore, an encoder 141 for determining the relative conveyance velocity is provided on the roller 126, in order that the relative conveyance velocity can be controlled. Moreover, if the relative conveyance velocity is to be controlled, then the inkjet recording apparatus 110 also comprises a frequency control device 142 which controls the discharge frequency of the print heads (112Y and so on), in such a manner that a prescribed dot pitch is obtained in the recorded image.

Furthermore, as described in detail below, the inkjet recording apparatus 110 according to the present embodiment comprises a bleeding evaluation print output device 144 for outputting a bleeding evaluation print used for determining and evaluating ink bleeding in order to perform high-quality image recording while preventing ink bleeding; and a parameter setting device 146 for setting optimal values for the respective control quantities, as control parameters, according to the results of evaluation of bleeding according to the outputted bleeding evaluation print.

The discharge volume control device (head driver 113) controls the discharge volume of the ink discharged from the print heads 112Y, 112C, 112M, and 112K onto the recording paper 116, and although not illustrated in the drawings, it controls the ink discharge volume by controlling the internal pressure of the ink inside the ink chamber, or the drive values of the actuator (piezoelectric element) which deforms the ink chamber. By controlling the ink discharge volume, it is possible to control the size of the discharge ink droplets, in other words, the diameter of the ink particle deposited onto the surface of the recording paper 116.

The conveyance control device 136 controls the rotational speed of the motor 128 according to a determination signal from the rotary encoder 141. In this case, if an optimal value is set for the relative conveyance velocity parameter, then the rotation of the motor 128 is controlled in such a manner that the relative conveyance velocity of the recording paper 116 assumes the set velocity.

The fixing control device 138 causes the ink to become fixed by applying fixing energy such as heat energy, or blowing a warm air flow by means of a fan, onto the ink deposited onto the recording paper 116, while controlling the level of this energy in accordance with the type of ink and the type of medium (the type of recording paper 116). Thereby, the ink is solidified and bleeding is prevented.

The bleeding prevention control device 140 prevents bleeding of the ink by controlling at least one of the head driver 113 (discharge volume control device), the conveyance control device 136, and the fixing control device 138. In specific terms, the control method involves controlling the respective control devices in accordance with the parameters established as respective optimal control quantities by the parameter setting device 146, as described below.

Furthermore, the frequency control device 142 controls the ink discharge timing from the respective print heads 112Y, 112C, 112M and 112K, in accordance with any change in the relative conveyance velocity of the recording paper 116, in such a manner that the prescribed dot pitch is obtained in the recorded image.

The system composition of the inkjet recording apparatus 110 according to the present embodiment is similar to that of the first embodiment and detailed description thereof is omitted.

Next, the method for setting optimal parameters in order to prevent color bleeding according to the present embodiment will be described.

For this purpose, firstly, an ink bleeding evaluation print is created. This bleeding evaluation pattern (bleeding evaluation print) is used to determine the degree of bleeding of the ink under different conditions, and it is created by discharging ink onto the recording paper 116 from the print heads 112Y, 112C, 112M, and 112K, at various different levels of the ink discharge volume (ink particle size $\phi$), relative conveyance velocity V, and fixing energy E.

Figure 17:
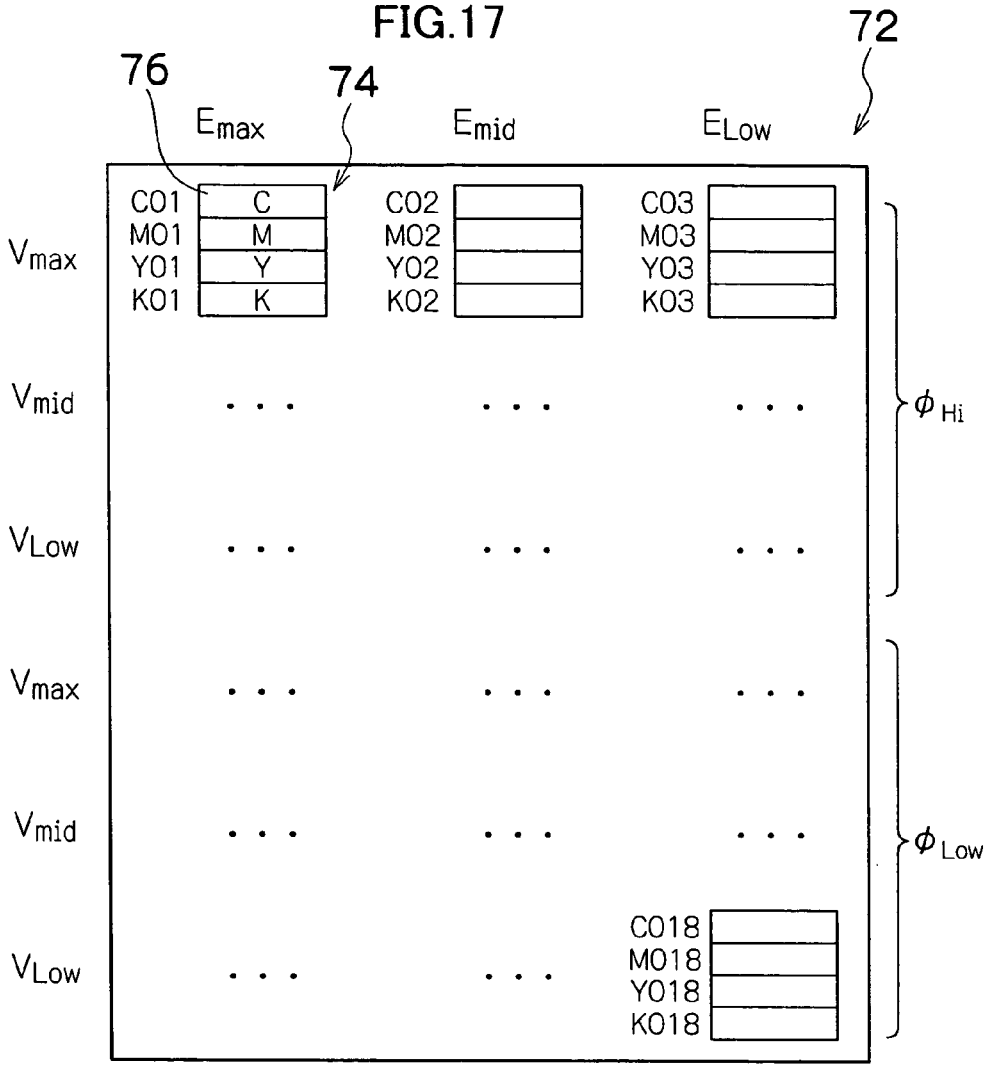
FIG. 17 is an illustrative diagram showing an example of a bleeding evaluation print according to a second embodiment.

FIG. 17 shows an example of an ink bleeding evaluation pattern (bleeding evaluation print) according to the present embodiment. As shown in FIG. 17, the bleeding evaluation print 72 is formed by recording bleeding evaluation patches 74 of each color of ink, at two different levels of the ink particle size, large $\phi_{Hi}$ and small $\phi_{Low}$, and three levels, max, mid and low, of the relative conveyance velocity V and the fixing energy E. Furthermore, the bleeding evaluation patches 74 are not limited to those illustrated, and they may incorporate other parameters and other factors relating to ink bleeding, such as the ambient printing temperature and humidity, or the like.

Figure 18:
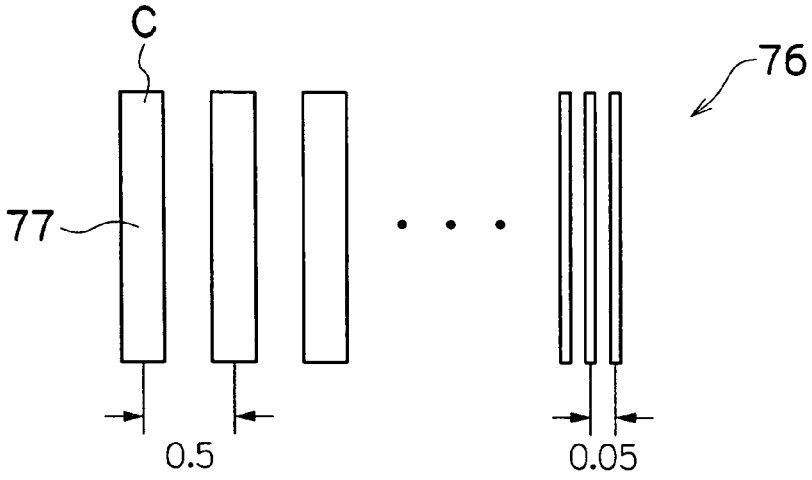
FIG. 18 is an illustrative diagram showing an enlarged view of a patch of the bleeding evaluation print in FIG. 17.

The patches 76 of each color in the respective bleeding evaluation patches 74 are recorded by gradually reducing the width and interval of respective lines 77 of a prescribed length recorded onto the medium, as shown by the enlarged view in FIG. 18. The interval between the lines 77 is initially 0.5 mm, for example, as shown in FIG. 18, but it gradually reduces until finally reaching a narrow interval of 0.05 mm. Between the regions of ink color, no ink is discharged and the background color of the recording paper 16 (usually white) is left. Consequently, the patches 76 are constituted by an alternating arrangement of ink color regions and white regions (the background color of the recording paper 16).

In this way, the bleeding evaluation print 72 comprises patches formed by lines of respective colors by varying the ink discharge volume (ink particle size $\phi$) at two different levels, and the relative conveyance velocity V and the fixing energy E at three different levels, respectively. Therefore, 2×3×3=18 bleeding evaluation patches 74 of this kind are formed. The patches 76 of each color in the respective bleeding evaluation patches 74 are each assigned with a number (chart number), such as C01-C18, M01-M18, . . . , and so on, in such a manner that they can be used subsequently to set the control parameters.

The bleeding evaluation print 72 is visually evaluated by the operator. In other words, as shown in FIG. 18, the patches 76 of the respective colors which constitute the bleeding evaluation patches 74 according to the present embodiment each form a resolution chart of gradually decreasing line width and line interval. The operator evaluates bleeding by determining the position on the resolution chart up to which the gradually narrowing lines can be distinguished from each other by visual observation.

Below, the action of the present embodiment is described with reference to the flowchart in FIG. 19.

Figure 19:
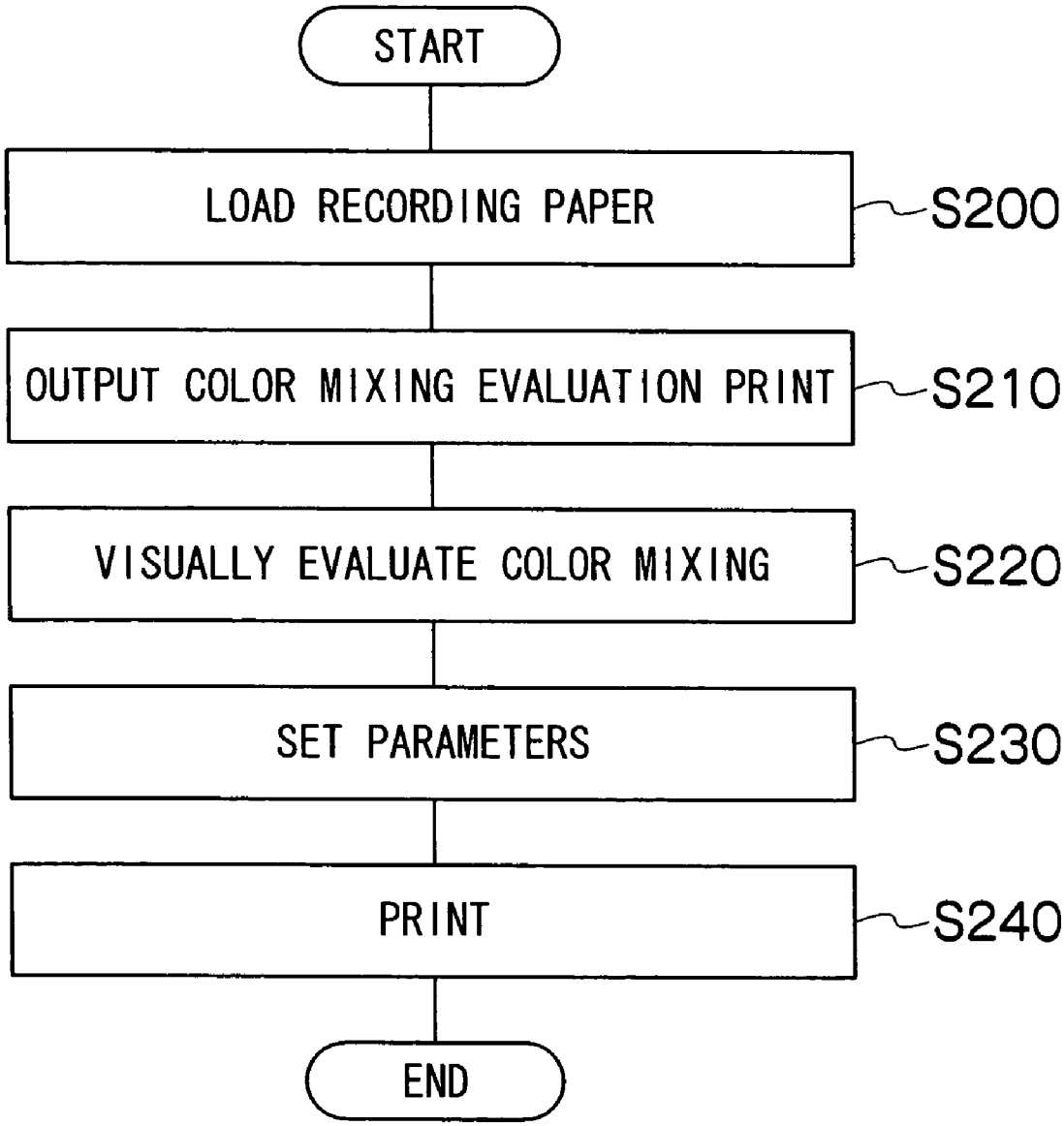
FIG. 19 is a flowchart illustrating the action of the present embodiment.

Firstly, at step S200 in FIG. 19, a magazine 122 for supplying recording paper 116 is loaded into the inkjet recording apparatus 110. When the magazine 122 is loaded, the medium type determination device 124 reads in medium type information from a medium type determination notch 122*a* attached to the magazine 122. The information read in by the medium type determination device 124 is supplied to the parameter setting device 146. At the same time, the ink type determination device 125 determines the ink type from the ink cartridge, or the like, and it reports this information to the parameter setting device 146. The medium type or ink type information may be inputted by the operator by means of the parameter setting device 146.

Next, at step S210, the print heads 112Y, 112C, 112M, and 112K are driven by the bleeding evaluation print output device 144 via the head driver 113, thereby outputting a bleeding evaluation print 72 as illustrated in FIG. 17 and described above.

Next, at step S220, the operator visually evaluates the outputted bleeding evaluation print. More specifically, the operator evaluates bleeding by identifying the point up to which the lines of gradually narrowing width and separation interval as shown in FIG. 18 can still be recognized as separate lines.

Thereupon, at step S230, control parameters are set according to the bleeding evaluation result and the current objectives. For example, if it is desired to record images at the highest possible speed, then a combination of control parameters including a high conveyance velocity V is selected. When the operator has selected the patch 76 corresponding to the optimal control parameters, then he or she enters the control parameters to the parameter setting device 146 by using the assigned patch number, such as C01 or M01.

In this case, the parameter setting device 146 stores the previously inputted medium type, ink type and control parameters in an associated fashion, and it sets these control parameters in the respective control devices.

Next, at step S240, the bleeding prevention control device 140 controls the respective control devices by means of the newly established control parameters, and therefore high-quality images in which bleeding is prevented are recorded.

In this way, according to the present embodiment, bleeding is visually evaluated by an operator according to a bleeding evaluation print, and therefore bleeding can be evaluated reliably and high-quality image recording in which bleeding is prevented can be achieved with any type of recording medium.

Furthermore, since the parameter setting device 146 stores the set control parameters in association with the medium type and the ink type, then when image recording is next performed using the same medium type and ink type, the stored control parameters can be called up and it is not necessary to output another bleeding evaluation print in order to set the control parameters.

In the embodiments described above, the print head is a line head having a long dimension in the breadthways direction of the recording paper, but the present invention is not limited to being a long line head and it may also be applied to a shuttle type head. In other words, in the case of a long line head, one line in the breadthways direction of the recording paper is recorded simultaneously in one action, whereas in a shuttle head, it is recorded by scanning the head in the breadthways direction of the paper. This is the only point of difference, and in all other respects the composition is the same.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method for evaluating bleeding into a recording medium of ink discharged onto the recording medium, the method comprising the steps of:

outputting a bleeding evaluation print including a plurality of bleeding evaluation patches created by recording lines of a prescribed length of ink colors, at a prescribed width, and varying at least one of a recording speed at which recording data is recorded onto the recording medium, a volume of ink discharged, and a fixing energy which fixes the discharged ink onto the recording medium, as a parameter, between a plurality of different levels;

measuring density of each of the bleeding evaluation patches in the outputted bleeding evaluation print;

evaluating the bleeding of the ink into the recording medium according to a density measurement result on the bleeding evaluation patches;

measuring density of lines of the ink colors constituting the bleeding evaluation patches in a substantially perpendicular direction to the lines;

calculating values relating to a maximum density, a raggedness which indicates extent of wavering of edges of the lines, and a width of the lines, according to a density measurement result on the lines; and evaluating the bleeding according to the values.

2. The method as defined in claim 1, further comprising the step of:

evaluating the bleeding by means of an evaluation value providing a numerical evaluation of bleeding by using previously established prescribed weighting factors corresponding to values of a difference between a previously established target density value of the lines and the calculated value of the density, a difference between a previously established target width value of the lines and the calculated width of the lines, and the raggedness.

3. The method as defined in claim 2, wherein the prescribed weighting factors are set in accordance with an image quality mode which indicates whether an item to be recorded is text, or image, or both text and image.

4. An image recording method for recording an image by discharging ink onto a recording medium according to recording data, the method comprising the step of performing image recording by setting control parameters for controlling at least one of the recording speed at which the recording data is recorded onto the recording medium, the discharge volume of ink to be discharged, and the fixing energy which fixes the discharged ink onto the recording medium, according to bleeding evaluation results obtained by the method as defined in claim 1.

5. The method as defined in claim 4, further comprising the step of setting control parameters in accordance with an image quality mode which indicates whether an item to be recorded is text, or image, or both text and image.

6. A bleeding evaluation apparatus for evaluating bleeding into a recording medium of ink discharged onto the recording medium, the apparatus comprising:

a bleeding evaluation print output device which outputs a bleeding evaluation print including a plurality of bleeding evaluation patches created by recording lines of a prescribed length of ink colors, at a prescribed width, and varying at least one of a recording speed at which recording data is recorded onto the recording medium, a volume of ink discharged, and a fixing energy which fixes the discharged ink onto the recording medium, as a parameter, between a plurality of different levels;

a density measurement device which measures density of each of the bleeding evaluation patches in the outputted bleeding evaluation print; and a bleeding evaluation device which evaluates the bleeding of the ink into the recording medium according to a density measurement result on the bleeding evaluation patches; wherein:

the density measurement device measures density of lines of the ink colors constituting the bleeding evaluation patches in a substantially perpendicular direction to the lines; and the bleeding evaluation device calculates values relating to a maximum density, a raggedness which indicates extent of wavering of edges of the lines, and a width of the lines, according to a density measurement result on the lines, and evaluates the bleeding by means of an evaluation value providing a numerical evaluation of bleeding by using previously established prescribed weighting factors corresponding to values of a difference between a previously established target density value of the lines and the calculated value of the density, a difference between a previously established target width value of the lines and the calculated width of the lines, and the raggedness.

7. The apparatus as defined in claim 6, further comprising:

an image quality mode determination device which determines an image quality mode indicating whether an item to be recorded is text, or image, or both text and image, according to the recording data, wherein the bleeding evaluation device sets the weighting factors in accordance with the determined image quality mode.

8. An image recording apparatus which records an image by discharging ink onto a recording medium according to recording data, the apparatus comprising:

a bleeding evaluation apparatus comprising:

a bleeding evaluation print output device which outputs a bleeding evaluation print including a plurality of bleeding evaluation patches created by recording lines of a prescribed length of ink colors, at a prescribed width, and varying at least one of a recording speed at which recording data is recorded onto the recording medium, a volume of ink discharged, and a fixing energy which fixes the discharged ink onto the recording medium, as a parameter, between a plurality of different levels;

a density measurement device which measures density of each of the bleeding evaluation patches in the outputted bleeding evaluation print; and a bleeding evaluation device which evaluates the bleeding of the ink into the recording medium according to a density measurement result on the bleeding evaluation patches;

the image recording apparatus further comprising:

a recording speed control device which controls the recording speed at which the recording data is recorded onto the recording medium;

a discharge volume control device which controls the volume of the ink discharged;

a fixing control device which controls the fixing energy which fixes the discharged ink onto the recording medium;

a parameter setting device which sets control parameters for controlling the recording speed control device, the discharge volume control device and the fixing control device, according to bleeding evaluation results obtained by the bleeding evaluation apparatus; and a bleeding prevention control device which implements image recording by controlling at least one of the recording speed control device, the discharge volume control device and the fixing control device, by means of the set control parameters.

9. The image recording apparatus as defined in claim 8, wherein the parameter setting device sets the control parameters in accordance with an image quality mode indicating whether an item to be recorded is text, or image, or both text and image, according to the recording data.

* * * * *